US008371578B2

(12) United States Patent
Ishikawa et al.

(10) Patent No.: US 8,371,578 B2
(45) Date of Patent: Feb. 12, 2013

(54) SHEET PROCESSING SYSTEM, APPARATUS CAPABLE OF REDUCING AMOUNT OF POSITIONAL ERROR OF CONVEYED SHEET, AND METHOD OF CONTROLLING SHEET PROCESSING SYSTEM

(75) Inventors: Naoki Ishikawa, Kashiwa (JP); Hitoshi Kato, Toride (JP); Yasuo Fukatsu, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/908,431

(22) Filed: Oct. 20, 2010

(65) Prior Publication Data

US 2011/0095472 A1 Apr. 28, 2011

(30) Foreign Application Priority Data

Oct. 26, 2009 (JP) ..... 2009-245533

(51) Int. Cl.
*B65H 7/02* (2006.01)

(52) U.S. Cl. ..... 271/227; 271/226; 271/228

(58) Field of Classification Search ..... 271/226, 271/227, 228, 234, 253, 254, 255
See application file for complete search history.

(56) References Cited

U.S. PATENT DOCUMENTS 7,520,497 B2 4/2009 Moriyama et al.
7,621,518 B2 * 11/2009 Iesaki et al. ..... 271/3.14
2004/0188929 A1 * 9/2004 Tada et al. ..... 271/248
2004/0239027 A1 * 12/2004 Trovinger et al. ..... 271/227
2008/0006992 A1 * 1/2008 Inoue ..... 271/228

FOREIGN PATENT DOCUMENTS

CN 2507829 8/2002
CN 101376467 3/2009
JP 2007-055748 A 3/2007

OTHER PUBLICATIONS

CN Office Action Oct. 10, 2012 for corresponding CN 201010527716.9.

* cited by examiner

*Primary Examiner* — Michael McCullough
*Assistant Examiner* — Howard Sanders
(74) *Attorney, Agent, or Firm* — Rossi, Kimms & McDowell LLP

(57) ABSTRACT

A sheet processing system capable of performing lateral shift correction of a sheet in an upstream sheet processing apparatus based on an amount of lateral shift to be caused by conveying thereof into a downstream sheet processing apparatus. A side edge sensor of a stacker detects a lateral shift amount of a sheet conveyed into the stacker. A stacker controller corrects lateral shift of the sheet by a shift unit. A side edge sensor of a finisher disposed downstream of the stacker detects a lateral shift amount of a sheet conveyed into the finisher. The finisher sends the detected lateral shift amount to the stacker. The stacker receives the lateral shift amount from the finisher, and the stacker controller corrects lateral shift of subsequent sheets based on both the lateral shift amount detected in the stacker and the lateral shift amount sent from the finisher.

17 Claims, 23 Drawing Sheets

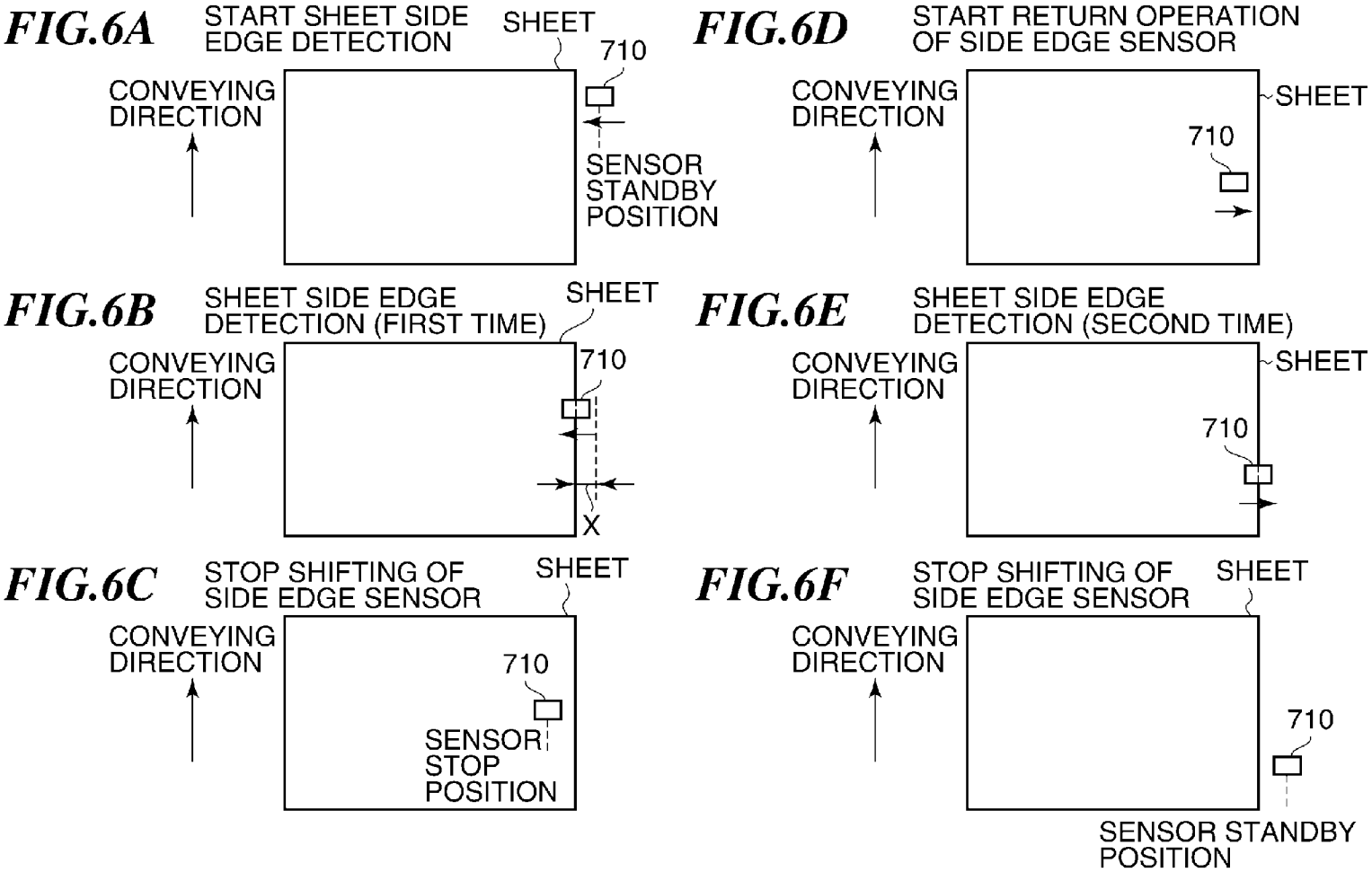
FIG.6A
START SHEET SIDE EDGE DETECTION
CONVEYING DIRECTION
SHEET
710
SENSOR STANDBY POSITION
FIG.6B
SHEET SIDE EDGE DETECTION (FIRST TIME)
CONVEYING DIRECTION
SHEET
710
X
FIG.6C
STOP SHIFTING OF SIDE EDGE SENSOR
CONVEYING DIRECTION
SHEET
710
SENSOR STOP POSITION
FIG.6D
START RETURN OPERATION OF SIDE EDGE SENSOR
CONVEYING DIRECTION
SHEET
710
FIG.6E
SHEET SIDE EDGE DETECTION (SECOND TIME)
CONVEYING DIRECTION
SHEET
710
FIG.6F
STOP SHIFTING OF SIDE EDGE SENSOR
CONVEYING DIRECTION
SHEET
710
SENSOR STANDBY POSITION

SHEET PROCESSING SYSTEM, APPARATUS CAPABLE OF REDUCING AMOUNT OF POSITIONAL ERROR OF CONVEYED SHEET, AND METHOD OF CONTROLLING SHEET PROCESSING SYSTEM

BACKGROUND OF THE INVENTION

1. Field of the Invention

The present invention relates to a sheet processing apparatus and a sheet processing system formed by connecting a plurality of sheet processing apparatuses. In particular, the present invention relates to correcting for positional errors of sheets of paper being input into and output out of the sheet processing apparatuses.

2. Description of the Related Art

Conventionally, there has been known a technique of correcting lateral shift or skew of a sheet so as to improve sheet processing accuracy in a sheet processing apparatus.

For example, in a sheet processing apparatus disclosed in Japanese Patent Laid-Open Publication No. 2007-055748, when hole punching is to be performed, a "lateral shift amount" indicative of an amount of sheet shift in a sheet width direction orthogonal to a sheet conveying direction is detected before execution of the hole punching. Then, "lateral shift correction" is performed in which the lateral shift amount is corrected and compensated for, whereby the accuracy of positioning punched holes is improved.

Further, in a sheet processing apparatus disclosed in U.S. Pat. No. 7,520,497, a "skew amount" indicative of the amount of angular shift of the leading edge of a sheet is detected before execution of hole punching, and "skew correction" is performed in which the skew amount is corrected and compensated for, whereby the accuracy of positioning of punched holes is improved.

As is apparent from the above description, hole punching performed by a sheet processing apparatus requires correction time for correcting the lateral shift or skew of a sheet and time for punching holes in the sheet. The required correction time depends on the lateral shift amount or skew amount of a sheet, and as the lateral shift amount or skew amount is larger, the correction time is longer. For this reason, processing steps are generally configured to attempt to process sheets efficiently even when the position correction time is at a maximum.

In a known sheet processing system, a plurality of sheet processing apparatuses are connected in series in a sheet conveying direction so as to perform various kinds of sheet processing such as stacking, folding, hole-punching, collating, stapling, etc., which tends to increase the total length of the sheet processing system. A longer sheet conveying passage is more likely to cause positional errors of a sheet. Further, the number of connection sections between processing apparatuses increases, so that positional errors are more likely to occur when the sheet passes between the apparatuses or through the connection sections therebetween.

To improve the processing accuracy of the apparatus and protect it against occurrence of a lateral shift or skew of a sheet, there has been proposed a system in which each of a plurality of connected sheet processing apparatuses is provided with not only a lateral shift detecting mechanism and a skew detecting mechanism, but also a lateral shift correcting mechanism and a skew correcting mechanism. Such a system is configured such that the lateral shift amount and the skew amount are detected and then lateral shift correction and skew correction are performed in each apparatus incorporating the above-mentioned mechanisms, so as to prevent degradation of sheet processing accuracy.

However, when a lateral shift or skew of a sheet occurs on a conveying passage in one of the apparatuses or in a connection section between two of the apparatuses, extra time is required for correcting the lateral shift or skew in an apparatus downstream of the conveying passage or connection section, which causes an increase in sheet processing time.

Let it be assumed that a stacker 400 is disposed on the upstream side and a finisher 100 is disposed on the downstream side, as shown in plan view in FIGS. 23A and 23C. Assuming that in a case where the stacker 400 on the upstream side is displaced laterally (or in a transverse direction) with respect to the sheet conveying direction toward the finisher 100 as shown in FIG. 23A, if a sheet P is subjected to lateral shift correction in the stacker 400 and is then conveyed out therefrom with the center of the sheet being positioned to the center of the stacker 400 in the transverse direction, the sheet conveyed into the finisher 100 on the downstream side is laterally shifted as shown in FIG. 23B. On the other hand, in a case where the stacker 400 on the upstream side is disposed in a state angularly displaced with respect to the conveying direction while the finisher 100 is straight, for example, as shown in FIG. 23C, a gap on the bottom of FIG. 23C representing the front side of the sheet processing system is created between the stacker 400 and the finisher 100. If a sheet discharged from the stacker 400 without being skewed with respect to the stacker 400 is conveyed into the finisher 100 in the above-mentioned state of the stacker 400 and the finisher 100, the sheet is skewed in the finisher 100, as shown in FIG. 23D. If the skew has the leading edge thereof slanted toward the front of the sheet processing system (downward as viewed in FIG. 23D), this may be referred to as a "frontwardly skewed state".

When the number of apparatuses connected in the system increases, even if each of the apparatuses is provided with a detecting mechanism for detecting a lateral shift or skew of a sheet and a correcting mechanism for correcting the lateral shift or skew of the sheet, lateral shift and skew can be caused when the sheet passes between the apparatuses. Further, with the increase in the number of the apparatuses, the number of connection sections inevitably increases, which is more likely to cause a lateral shift or skew of a sheet.

On the other hand, when lateral shift correction or skew correction is not properly performed in each of the apparatuses, there is a risk of accumulation of lateral shift or skew of a sheet before the sheet reaches the next sheet processing apparatus downstream thereof. When sheet processing is performed by the downstream sheet processing apparatus, sheet position correction time corresponding to the accumulated amount of lateral shift or skew of the sheet is needed for the sheet processing. Therefore, it is necessary to secure sufficient correction time for performing the lateral shift correction or skew correction in the downstream apparatus. For this reason, it is necessary to perform processing with a sufficient sheet feed interval, and hence there is a risk of the productivity of the system being reduced. However, an attempt to shorten the correction time so as to prevent reduced productivity leads to degraded processing accuracy.

Further, depending on the direction of shift of a sheet or that of displacement between adjacent apparatuses, the direction of a correction to be performed by each apparatus can be opposite to that of a correction previously performed, and hence it is possible that a correction in an upstream apparatus is negated by a positional error further downstream.

SUMMARY OF THE INVENTION

An embodiment of the present invention provides a sheet processing system which is capable of performing position correction of a sheet in an upstream sheet processing apparatus based on an amount of positional error predicted to be caused by conveying of the sheet into a downstream sheet processing apparatus, to thereby reduce the amount of positional error of the sheet conveyed into the downstream sheet processing apparatus.

In a first aspect of the present invention, there is provided a sheet processing system including a first sheet processing apparatus and a second sheet processing apparatus disposed downstream of the first sheet processing apparatus in a sheet conveying direction, wherein the first sheet processing apparatus comprises a first detection unit configured to detect a first positional error of a sheet conveyed into the first sheet processing apparatus, and a correction unit configured to correct a position of the sheet, and wherein the second sheet processing apparatus comprises a second detection unit configured to detect a second positional error of the sheet conveyed into the second sheet processing apparatus, and a transmission unit configured to send the second positional error detected by the second detection unit to the first sheet processing apparatus, and wherein the first sheet processing apparatus further comprises a reception unit configured to receive the second positional error sent from the transmission unit of the second sheet processing apparatus, and wherein the correction unit is further configured to correct a position of subsequent sheets based on both the first positional error detected by the first detection unit and the second positional error received by the reception unit.

In a second aspect of the present invention, there is provided a sheet processing apparatus comprising a detection unit configured to detect a first positional error of a sheet conveyed into the sheet processing apparatus, a correction unit configured to correct a position of the sheet, and a reception unit configured to receive a second positional error detected and sent by a downstream sheet processing apparatus disposed downstream of the sheet processing apparatus, wherein the correction unit is configured to correct a position of subsequent sheets based on both the first positional error detected by the detection unit and the second positional error received by the reception unit.

In a third aspect of the present invention, there is provided a sheet processing apparatus comprising a detection unit configured to detect a s positional error of a sheet conveyed into the sheet processing apparatus, and a transmission unit configured to send the positional error to an upstream sheet processing apparatus.

In a fourth aspect of the present invention, there is provided a method of controlling a sheet processing system that comprises an upstream sheet processing apparatus and a downstream processing apparatus, each sheet processing apparatus comprising a detection unit for detecting a sheet positional error and a correction unit for correcting the sheet position if a sheet positional error is detected, the method comprising, in the upstream sheet processing apparatus, detecting a first positional error of a sheet conveyed into the upstream sheet processing apparatus, in the downstream sheet processing apparatus, detecting a second positional error of a sheet conveyed into the downstream sheet processing apparatus, transmitting a signal containing the second positional error from the downstream sheet processing apparatus to the upstream sheet processing apparatus, receiving the signal containing the second positional error in the upstream sheet processing apparatus, and correcting for both the first and second positional errors in the upstream sheet processing apparatus using the detected first positional error and the received second positional error.

An advantage of embodiments of the invention is that it is possible to reduce the amount of actual lateral shift and/or skew of a sheet conveyed into the downstream sheet processing apparatus by performing lateral shift and/or skew correction of the sheet in the upstream sheet processing apparatus based on the amount of lateral shift and/or skew caused by conveying of the sheet into the downstream sheet processing apparatus.

Further features of the present invention will become apparent from the following description of exemplary embodiments with reference to the attached drawings.

BRIEF DESCRIPTION OF THE DRAWINGS

FIGS. 6A to 6F are schematic views illustrating the operation of a side edge sensor of the stacker in time series.

DETAILED DESCRIPTION OF THE EMBODIMENTS

The present invention will now be described in detail below with reference to the accompanying drawings showing embodiments thereof.

Figure 1:
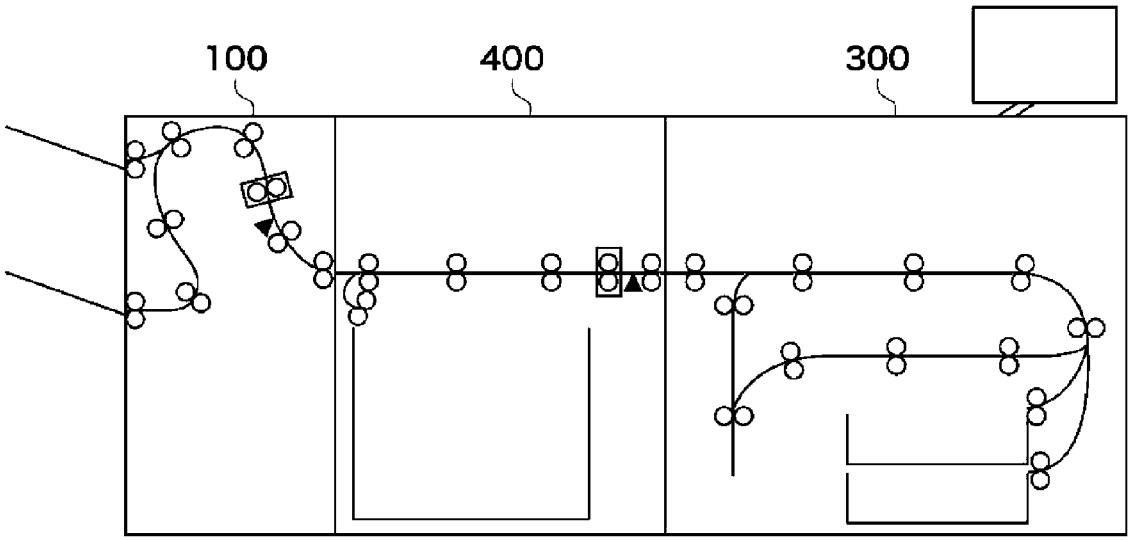
FIG. 1 is a schematic view of an image forming system.

FIG. 1 is a view of a sheet processing system according to an embodiment of the present invention. As shown in FIG. 1, the sheet processing system comprises a plurality of sheet processing apparatuses for performing sheet processing, and the sheet processing apparatuses are connected in series in a sheet conveying direction. In the present example, the system has an image forming apparatus 300, a stacker 400, and a finisher 100 connected in the mentioned order from upstream to downstream. The sheet processing system, however, may include any number of any types of sheet processing apparatuses connected therein.

Generic terms (such as those used in the claims) and their more specific counterpart terms used in the specific description are listed hereinbelow.

Figure 4:
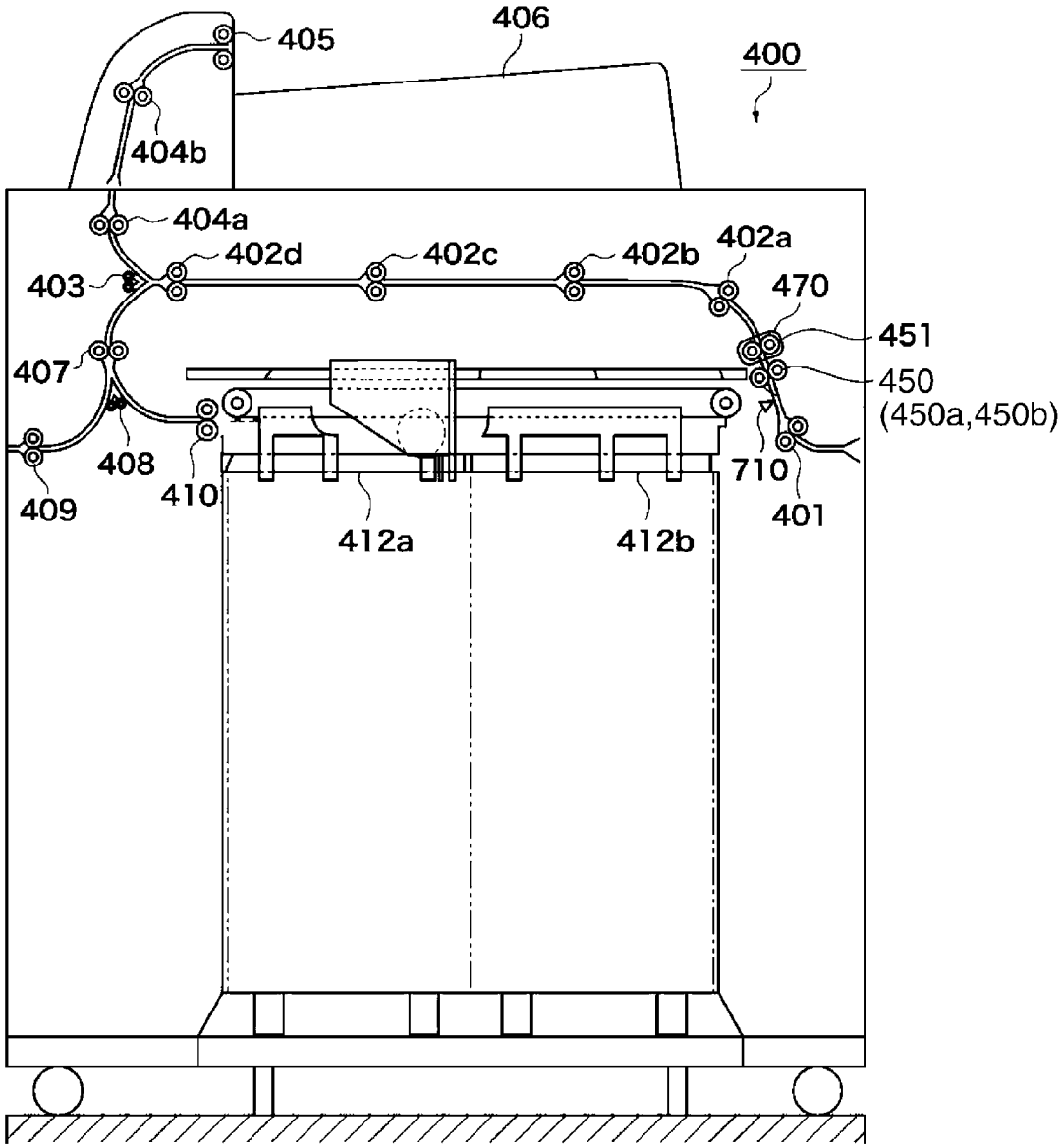
FIG. 4 is a longitudinal cross-sectional view of a stacker.

The stacker 400 of the present embodiment corresponds to a "first sheet processing apparatus", and the finisher 100, to a "second (downstream) sheet processing apparatus". A stacker controller 701 (as will be described with respect to FIGS. 5 and 11) and a side edge sensor 710 form a "first detector unit" or "first detection means. A finisher controller 501 and a side edge sensor 104 form a "second detector unit" or "second detection means". The stacker controller 701 and a shift unit 470 (c.f. FIG. 4) together form a "first correction unit" or "first correction means". The stacker controller 701 and a skew correction roller pair 450 form a "second correction unit" or "second correction means". The stacker controller 701 is also known as an "instruction unit" or "instruction means". A communication IC (integrated circuit) 550 is a specific form of a "transmission unit" or "transmission means". A communication IC 750 is a specific form of a "reception unit" or "reception means".

Figure 2:
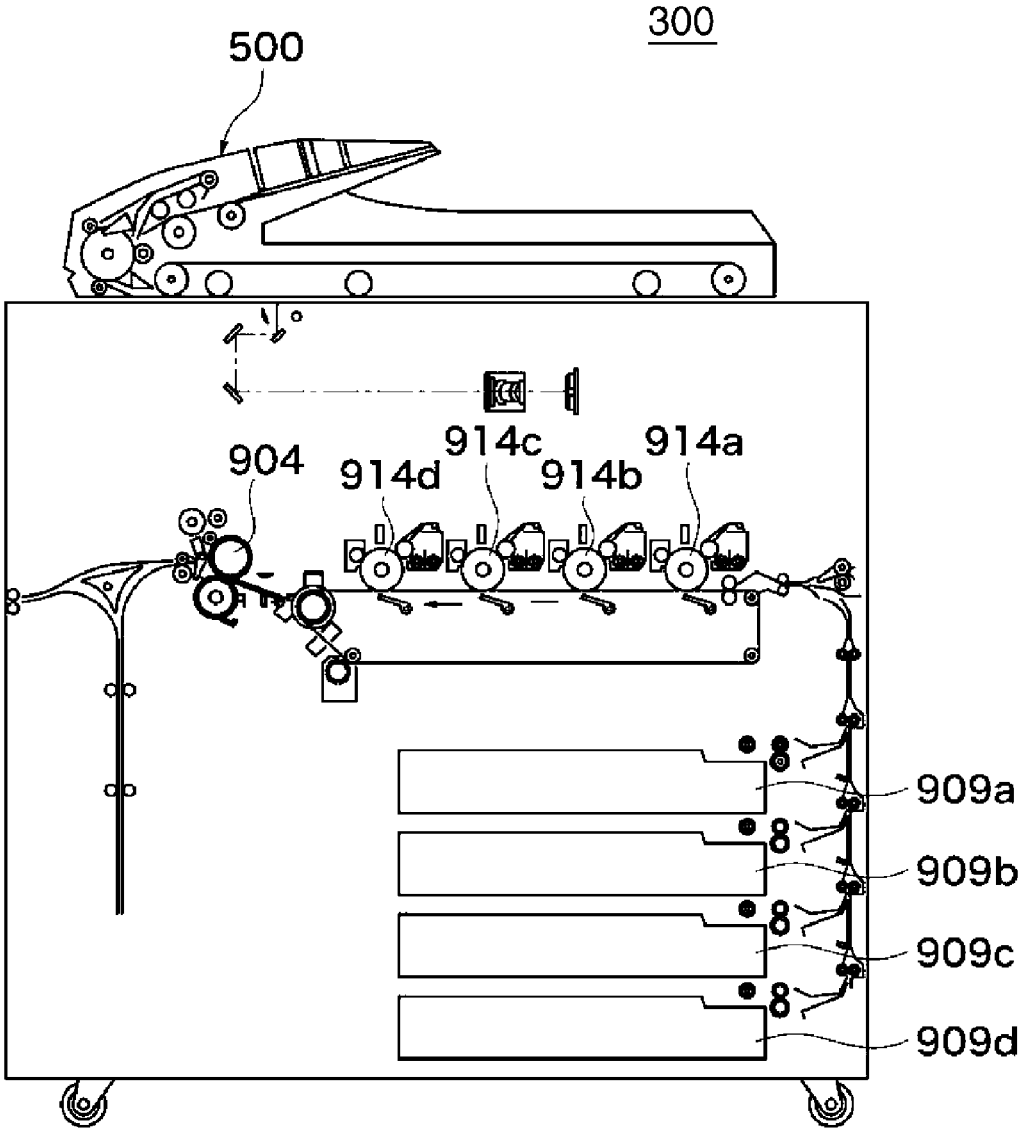
FIG. 2 is a schematic longitudinal cross-sectional view of an image forming apparatus.

FIG. 2 is a schematic longitudinal cross-sectional view of the image forming apparatus 300 disposed at an upstream end of the sheet processing system according to the present embodiment. The image forming apparatus 300 may, for example, be a black-and-white/color copying machine. The image forming apparatus 300 comprises an automatic document feeder 500, yellow, magenta, cyan, and black photosensitive drums 914*a* to 914*d* as image forming units, a fixing unit 904, and cassettes 909*a* to 909*d* containing sheets.

A sheet fed from one of the cassettes 909*a* to 909*d* is conveyed to the photosensitive drums 914*a* to 914*d*, and four color-toner images are sequentially transferred onto the sheet by the photosensitive drums 914*a* to 914*d*. Then, the sheet is conveyed to the fixing unit 904, where the full-color toner image is fixed on the sheet, followed by the sheet being discharged (conveyed) out of the apparatus. The image forming apparatus 300 includes other component elements, not shown, necessary for the copying function of the apparatus, but description thereof is omitted.

Figure 3:
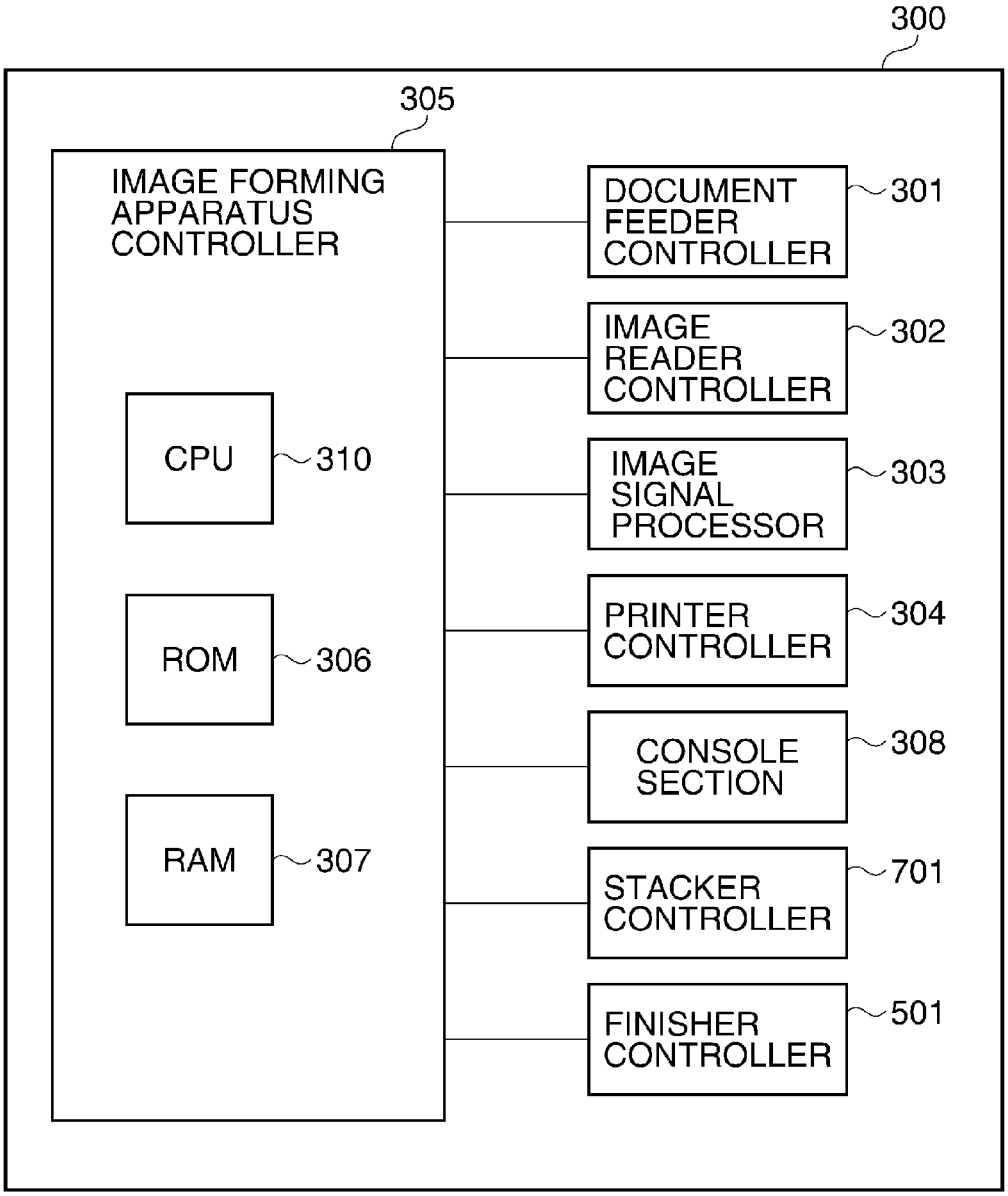
FIG. 3 is a block diagram of a control system of the image forming apparatus.

FIG. 3 is a block diagram of a control system of the image forming apparatus 300. As shown in FIG. 3, the image forming apparatus 300 includes the image forming apparatus controller 305. The image forming apparatus controller 305 incorporates a CPU (Central Processing Unit) 310, and a ROM (Read Only Memory) 306 and a RAM (Random Access Memory) 307 as storage units. Connected to the image forming apparatus controller 305 are a document feeder controller 301, an image reader controller 302, an image signal processor 303, the printer controller 304, a console section 308, the stacker controller 701, and the finisher controller 501. These blocks are controlled in a centralized manner by executing control programs stored in the ROM 306. The RAM 307 temporarily stores control data, and is also used as a work area for carrying out arithmetic operations involved in control processing.

The document feeder controller 301 controls the automatic document feeder 500 according to instructions from the image forming apparatus controller 305. The image reader controller 302 controls a light source, not shown, a lens system, not shown, and so forth of the image forming apparatus 300, and transfers a read analog image signal to the image signal processor 303. The image signal processor 303 converts the analog image signal into a digital signal, then performs various kinds of processing on the digital signal, and converts the processed digital signal into a video signal to deliver the video signal to the printer controller 304. The processing operations performed by the image signal processor 303 are controlled by the image forming apparatus controller 305.

The console section 308 includes a plurality of keys for enabling the configuration (e.g. by a user) of various functions for image forming operation, and a display section for displaying information indicative of settings. A key signal associated with each key operation of the console section 308 is delivered to the image forming apparatus controller 305 functioning as a computation unit and an input unit. Further, in response to a signal from the image forming apparatus controller 305, corresponding information is displayed on the display section of the console section 308.

The image forming apparatus controller 305 selects one of a first sheet interval and a second sheet interval, and controls the printer controller 304 such that sheets are conveyed at the selected sheet interval. Usually, the longer sheet interval is selected. The selection between the two intervals is made according to a selection instruction from the finisher 100, as described hereinafter.

Figure 5:
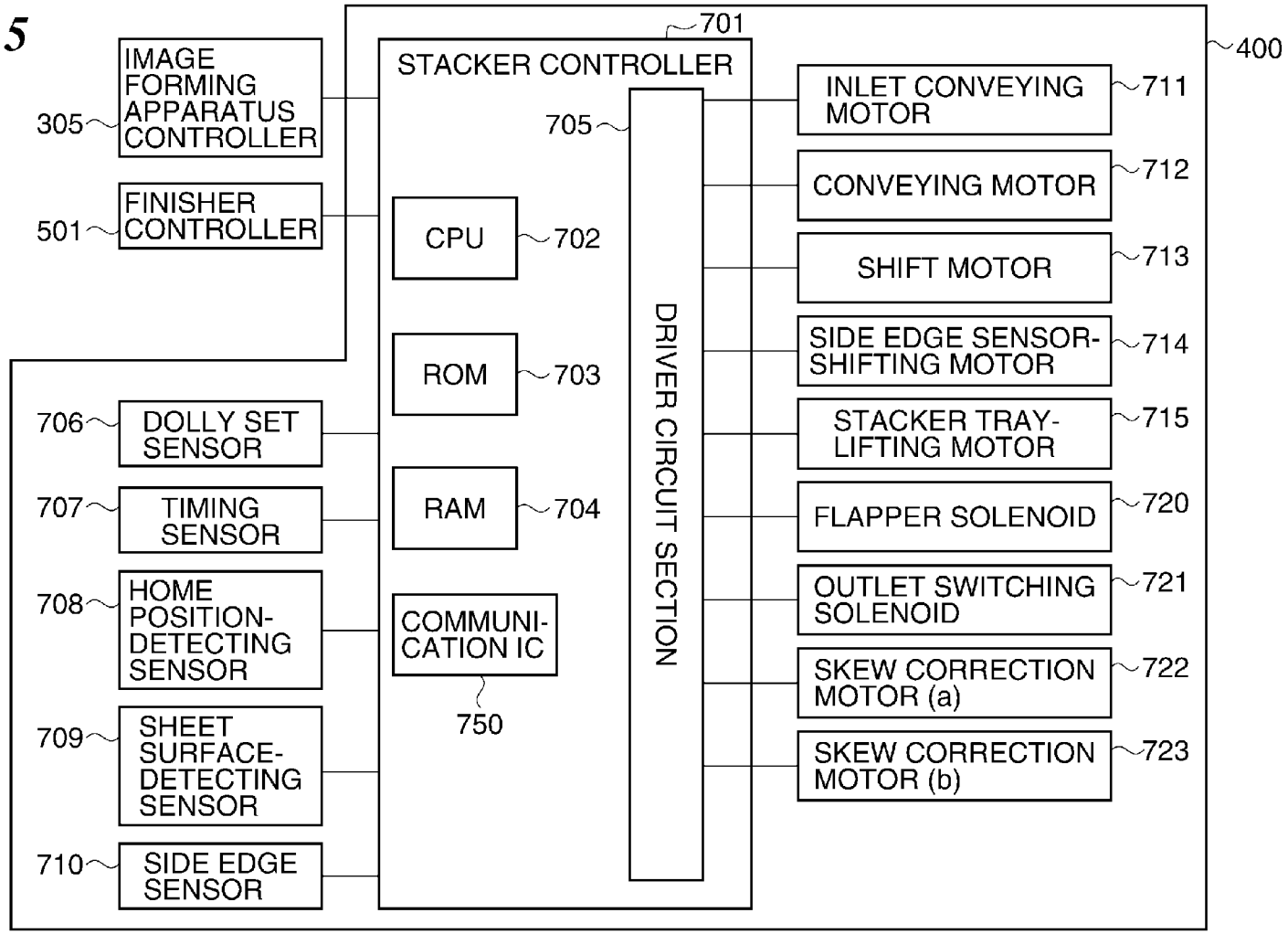
FIG. 5 is a block diagram of a control system of the stacker.

FIG. 4 is a longitudinal cross-sectional view of the stacker 400. FIG. 5 is a block diagram of a control system of the stacker 400. As shown in FIG. 5, the stacker 400 includes the stacker controller 701. The stacker controller 701 comprises a CPU 702, a ROM 703, a RAM 704, the communication IC 750, and a driver circuit section 705.

The stacker controller 701 is capable of communicating with the image forming apparatus controller 305 and the finisher controller 501 (see FIGS. 3 and 11) via the communication IC 750. Various actuators and sensors are controlled based on control programs stored in the ROM 703. The various sensors include a dolly set sensor 706, a timing sensor 707, a home position-detecting sensor 708, a sheet surface-detecting sensor 709, and the side edge sensor 710. The various actuators include an inlet conveying motor 711, a conveying motor 712, a shift motor 713, a side edge sensor-shifting motor 714, and a stacker tray-lifting motor 715. Further, the various actuators include a flapper solenoid 720, an outlet switching solenoid 721, a skew correction motor (a) 722, and a skew correction motor (b) 723.

As shown in FIG. 4, a sheet discharged from the image forming apparatus 300 on the upstream side is conveyed into the stacker 400 by an inlet roller pair 401 and then further conveyed to a top tray switching flapper 403 by conveying roller pairs 402 (402*a* to 402*d*). Before a sheet is conveyed into the stacker 400, sheet information is sent in advance to the stacker controller 701 from the CPU 310 (see FIG. 3) of the image forming apparatus controller 305 of the image forming apparatus 300. The sheet information includes sheet size information, sheet type information, sheet discharge destination information, and so forth.

Disposed downstream of the inlet roller pair 401 is the side edge sensor 710 formed by an LED (Light Emitting Diode) and a phototransistor. The side edge sensor 710 can be shifted by the side edge sensor-shifting motor 714 in a sheet width direction orthogonal to the sheet conveying direction. The side edge sensor 710 moves to detect a side edge of a sheet being conveyed. Based on the detected side edge of the sheet, the stacker controller 701 can detect and compute a positional error such as a lateral shift amount X (see FIG. 6B) and a skew amount L6 (see FIGS. 7A and 7B) of the sheet. The side edge sensor 710 may have any construction insofar as it is capable of detecting a sheet side edge.

Arranged downstream of the side edge sensor 710 are the skew correction roller pair 450 and a shift conveying roller pair 451 in the mentioned order. The skew correction roller pair 450 comprises a pair of skew correction rollers 450*a* and 450*b* arranged in the sheet width direction orthogonal to the sheet conveying direction. These rollers can be driven independently by the skew correction motor (a) 722 and the skew correction motor (b) 723, respectively. When a skew of a sheet is detected, one of the skew correction motor (a) 722 and the skew correction motor (b) 723 is decelerated and the other maintains its speed, thus correcting the skew of the sheet.

The shift conveying roller pair 451 is driven by the conveying motor 712 to convey a sheet. Further, the shift conveying roller pair 451 can be shifted by the shift motor 713 in the sheet width direction orthogonal to the sheet conveying direction. The shift conveying roller pair 451 constitutes the shift unit 470. The shift unit 470 corrects a lateral shift of a sheet based on the lateral shift amount X of the sheet by moving the shift conveying roller pair 451 laterally as required. A sheet conveyed into the stacker 400 by the inlet roller pair 401 has a side edge thereof detected by the side edge sensor 710, and the lateral shift amount and the skew amount of the sheet are computed by the stacker controller 701. After the sheet conveyed into the stacker 400 reaches the shift conveying roller pair 451, sheet position correction (e.g. skew correction and lateral shift correction) for correcting or compensating for a lateral shift and a skew is performed by the skew correction roller pair 450 and the shift unit 470 based on the computed lateral shift amount X and skew amount L6. Each of the side edge sensor-shifting motor 714 and the shift motor 713 is implemented by a pulse motor, so that each of the travel distances of the side edge sensor 710 and the shift unit 470 can be determined based on the number of pulses.

After completion of the sheet position correction, the stacker controller 701 determines whether or not the discharge destination of the sheet is a top tray 406. If the discharge destination of the sheet is the top tray 406, the top tray switching flapper 403 is driven by the flapper solenoid 720. In this case, the sheet is guided by conveying roller pairs 404*a* and 404*b* and discharged to be stacked on the top tray 406 by a top tray discharge roller 405. If the discharge destination of the sheet is not the top tray 406, it is determined whether the discharge destination of the sheet is a stacker tray 412*a* or 412*b* or the downstream sheet processing apparatus. If the discharge destination is the stacker tray 412*a* or 412*b*, the sheet conveyed by the conveying roller pairs 402 is selectively discharged onto the stacker tray 412*a* or 412*b* by a stacker tray discharge roller 410 to be stacked on the selected stacker tray 412*a* or 412*b*.

If the sheet is to be conveyed not to the stacker tray 412*a* or 412*b*, but to a downstream sheet processing apparatus, a stacker outlet switching flapper 408 is driven by the outlet switching solenoid 721. In this case, the sheet conveyed by the conveying roller pairs 402 is further conveyed by the conveying roller pair 407 to a stacker outlet roller pair 409, followed by being conveyed into the downstream sheet processing apparatus.

FIGS. 6A to 6F are schematic views illustrating the operation of the side edge sensor 710 in the stacker 400 in time series. The vertical and horizontal scales of a sheet in each of FIGS. 6A to 6F do not exactly correspond to the actual size of the sheet but are schematic representations of the sheet dimensions.

When a job is started, the side edge sensor 710 is moved by the side edge sensor-shifting motor 714 to a standby position determined based on the size of the sheet. The standby position may be located at the right side (as viewed in FIGS. 6A to 6F) of the apparatus. This right side of the sheet-conveying direction may be the back side of the apparatus (as opposed to the front side, which is commonly understood to be the side of the apparatus on which the user stands) and which is sometimes referred to hereinbelow as the "depth side". When the sheet is conveyed to a position facing the side edge sensor 710, the side edge sensor 710 starts moving from the standby position in a direction for detecting the side edge of the sheet (see FIG. 6A). FIG. 6A shows an exemplary case where the side edge sensor 710 has not yet detected the sheet at a "sheet side edge detection start time" when the side edge sensor 710 is in the standby position. In this case, the side edge sensor 710 reciprocates in a direction perpendicular to the conveying direction of the sheet, starting at the right (back side of the apparatus) and moving left then back to the right again. On the other hand, in a case where the side edge sensor 710 has detected the sheet at the "sheet side edge detection start time", the side edge sensor 710 reciprocates starting at the left and going right in a first stroke then back to the left in a second stroke.

The side edge sensor 710 starts moving and detects the sheet edge side during the movement (first time: see FIG. 6B). In each leftward stroke (performed once for each sheet), the side edge sensor 710 moves over a predetermined distance as a sheet side edge detecting operation. After having moved over the predetermined distance, the side edge sensor 710 stops (see FIG. 6C). Then, the side edge sensor 710 is driven by the side edge sensor-shifting motor 714 to start moving in the opposite direction (see FIG. 6D) toward the standby position. The side edge sensor 710 detects the sheet edge side during the movement the opposite direction as well (second time: see FIG. 6E). In the return stroke, the side edge sensor 710 stops after moving over the predetermined distance, and is then on standby at the standby position (see FIG. 6F).

Next, a description will be given of a method of detecting the lateral shift amount X by taking the stacker 400 as an example. When the side edge of a sheet is detected by the side edge sensor 710, the distance of travel of the side edge sensor 710 from the standby position to a location where the sheet side edge was detected is computed. The computed travel distance corresponds to the lateral shift amount X of the sheet (see FIGS. 6B and 10). Assuming that the number of pulses of the side edge sensor-shifting motor 714 counted until detection of a sheet side edge is represented by p and the amount of advance of the side edge sensor-shifting motor 714 per one pulse is represented by d, the lateral shift amount X is obtained by the following equation (1):

$$X=p\times d \tag{1}$$

Let it be assumed that X represents a positive value and information indicative of a shift direction is attached to the lateral shift amount X. The shift direction can be judged with respect to the direction of the first stroke of the side edge sensor 710 and can thus be judged to be shifted either toward the front side of the apparatus (laterally to the left with respect to the sheet conveying direction of the illustrated embodiment) or toward the back (or "depth") side of the apparatus. The shift distance is measured with respect to the center of the sheet conveying passage. In the illustrated embodiment, the direction of the first stroke of the side edge sensor 710 is toward the front side of the apparatus such that a shift to the left is a shift in the direction of the first stroke of the side edge sensor 710.

Figure 7A:
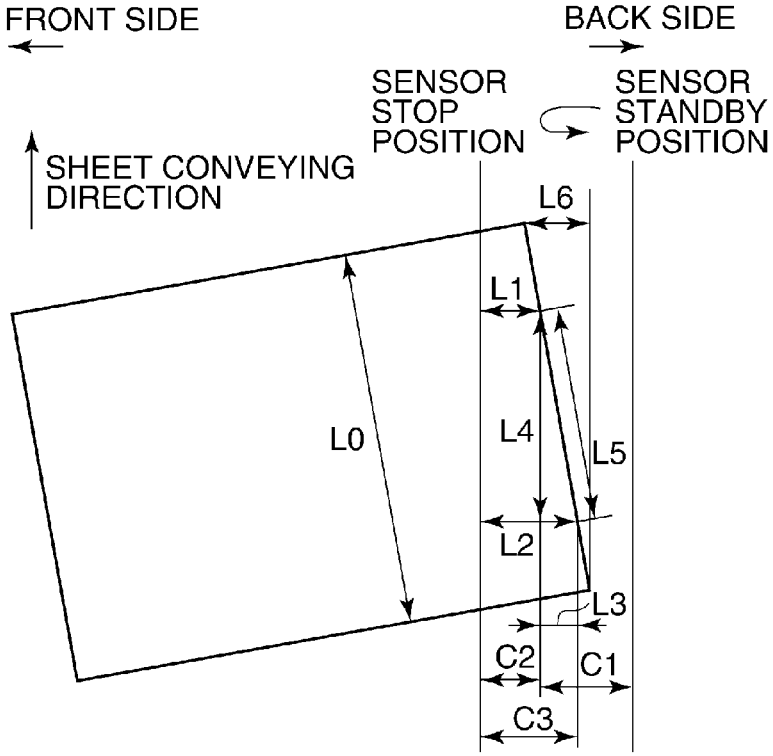
FIGS. 7A and 7B illustrate skew amount detection in the stacker.

Next, a description will be given of a method of detecting the skew amount L6 by taking the stacker 400 as an example and by referring to FIGS. 7A and 7B. The vertical and horizontal scales of a sheet in each of FIGS. 7A and 7B do not exactly correspond to the actual size of the sheet, but are schematic representations of sheet dimensions. The skew amount L6 is detected by comparing: 1) a travel distance L1 of the side edge sensor 710 between a location where it detects the side edge of a sheet and a location where the side edge sensor 710 stops at the end of its first stroke (which is assumed to be after the detection of the side edge of the sheet) with 2) a travel distance L2 between a location where the side edge sensor 710 starts a return stroke after the stoppage and a location where the side edge sensor 710 detects the sheet side edge again. Hereafter, a skewed state where the right side of the leading edge of a sheet in the sheet conveying direction advances forward before the left side of the leading edge of the sheet (see FIG. 7A) will be referred to as "a skew toward the front side" (the "front" being the front of the apparatus), and a skewed state inverse to the above (see FIG. 7B) will be referred to as "a skew toward the back side".

Detection of the skew amount L6 is performed in parallel with detection of the lateral shift amount X. FIG. 7A illustrates an exemplary case where at a time point when a sheet has reached a position in front of the side edge sensor 710, the sheet is in a skew toward the front side and the side edge sensor 710 in the standby position has not detected the sheet yet. On the other hand, FIG. 7B illustrates an exemplary case where at a time point when a sheet has reached a position facing the side edge sensor 710, the sheet is in a skew toward the back side and the side edge sensor 710 in the standby position has detected the sheet.

The skew amount L6 can be detected and computed as follows: First, in a case where the side edge sensor 710 in the standby position has not detected the sheet as shown in FIG. 7A, L1 represents a distance of travel of the side edge sensor 710 from a location of a first sheet side edge detection to a stop position in a forward stroke. L2 represents a distance of travel of the side edge sensor 710 from the stop position to a location of a second sheet side edge detection in a return stroke toward the standby position.

Figure 7B:
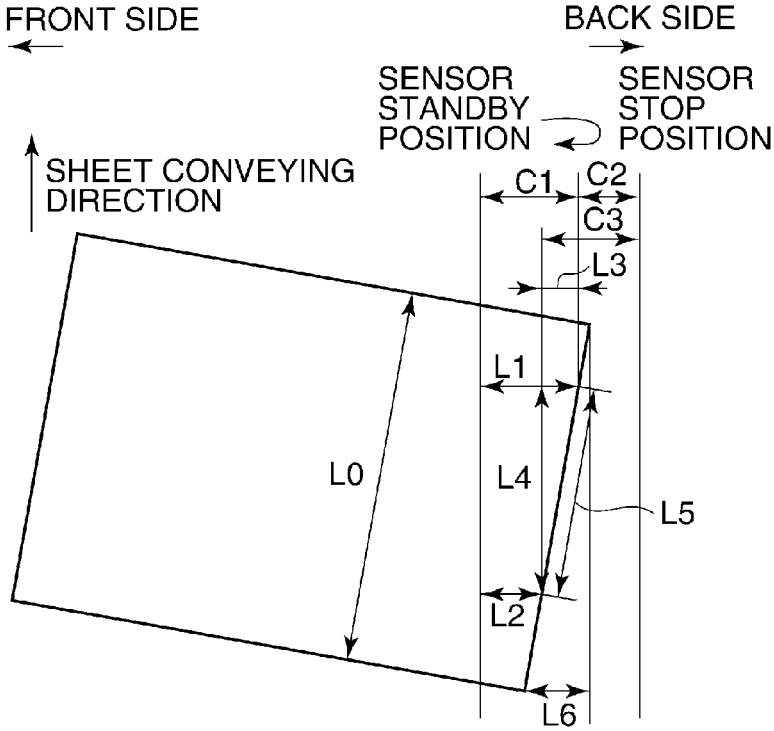

On the other hand, in a case where the side edge sensor 710 in the standby position has detected the sheet as shown in FIG. 7B, L1 represents a distance of travel of the side edge sensor 710 from the standby position to a location of a first sheet side edge detection in a forward (rightward) stroke. L2 represents a distance of travel of the side edge sensor 710 from a location of a second sheet side edge detection to the standby position in a return stroke.

During the reciprocating operation of the side edge sensor 710, the stacker controller 701 counts the number of pulses from the side edge sensor-shifting motor 714 (see FIG. 5). In each of FIGS. 7A and 7B, C1 represents the number of pulses counted over a time period of the travel of the side edge sensor 710 from the standby position to the location of the first sheet side edge detection in the forward stroke. C2 represents the number of pulses counted over a time period of the travel of the side edge sensor 710 from the location of the first sheet side edge detection to the stop position in the forward stroke. C3 represents the number of pulses counted over a time period of the travel of the side edge sensor 710 from the stop position to the location of the second sheet side edge detection in the return stroke.

A travel distance is obtained by multiplying the advance amount d per one pulse of the side edge sensor-shifting motor 714 by the number of pulses. In the exemplary case of FIG. 7A, the travel distances L1 and L2 are computed from the pulse counts C2 and C3, respectively. In the exemplary case in FIG. 7B, the travel distance L1 is computed from the pulse count C1, and the travel distance L2 is computed from a pulse count determined by (C1+C2−C3).

Next, (L2−L1) or (L1−L2) as the difference (positive value) between the travel distances L1 and L2 is computed as a distance L3. The stacker controller 701 counts a sheet conveyance distance over which the sheet is conveyed from a time point of the first sheet side edge detection by the side edge sensor 710 to a time point of the second sheet side edge detection by the same, and sets the distance as a distance L4. Then, a hypotenuse length L5 is computed from the difference L3 and the sheet conveyance distance L4 using the Pythagorean Theorem ($L5^2=L4^2+L3^2$)). The skew amount L6, the difference L3, the hypotenuse length L5, and a sheet length L0 as a sheet length in the sheet conveying direction satisfy the relationship of L3:L5=L6:L0 (also written as L3/L5=L6/L0). The sheet length L0 is obtained from sheet information sent from the image forming apparatus 300 to the stacker controller 701. The skew amount L6 can be computed by the following equation (2):

$$L6=(L3/L5)\times L0 \quad (2)$$

A skew direction of the sheet is judged from the difference in magnitude between the travel distances L1 and L2. If L1<L2, the sheet is in a skew toward the front side, and if L1>L2, the sheet is in a skew toward the back side. Skew direction information is attached to the skew amount L6.

The finisher 100 employs the same method as the above-described detection and computation method used in the stacker 400 to detect and compute a lateral shift amount and a skew amount.

Figure 8:
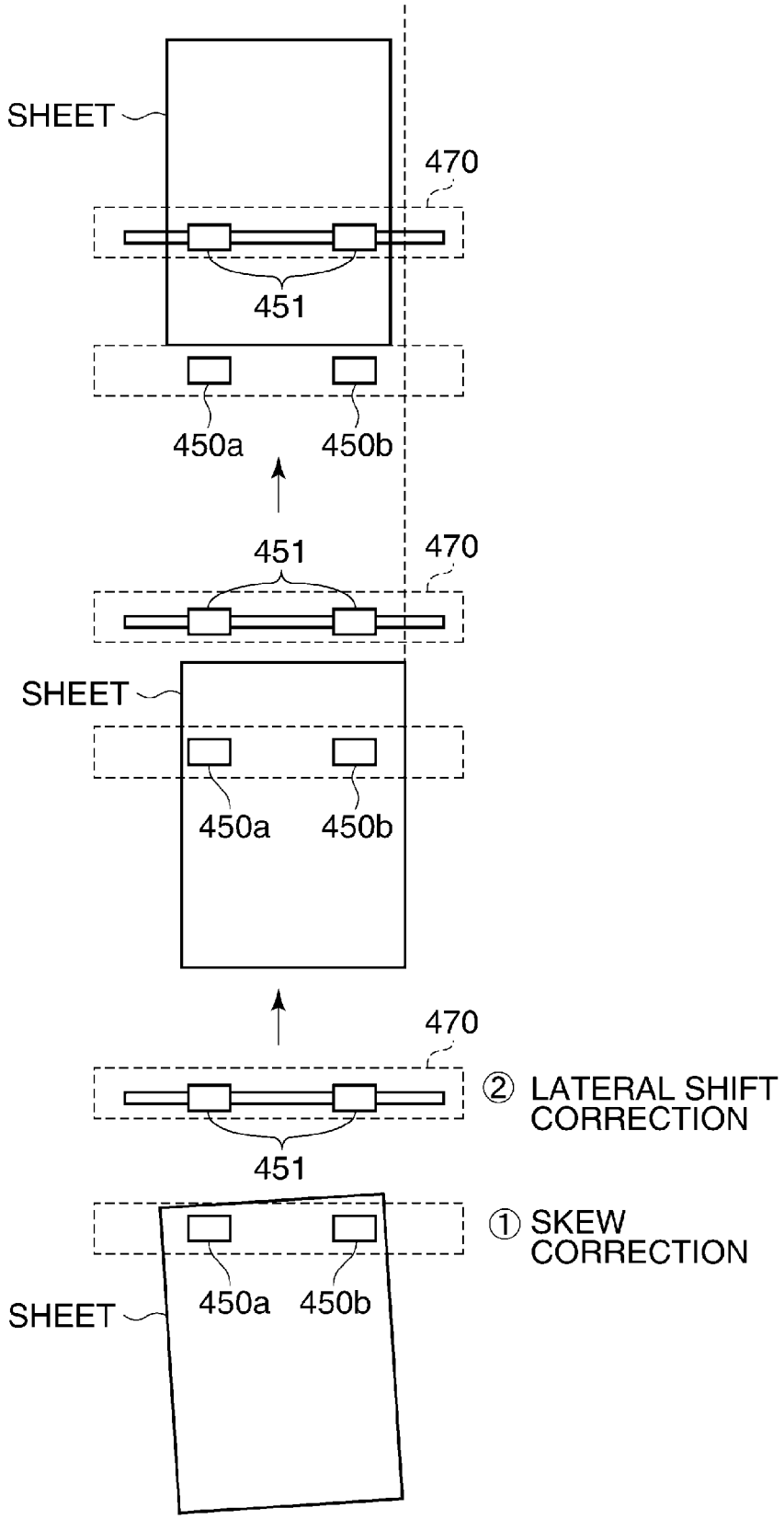
FIG. 8 illustrate a skew correcting operation in time series.

Next, a description will be given, with reference to FIG. 8, of the operation of the stacker 400 for lateral shift correction and skew correction. In the stacker 400, the sheet position correction is executed in the order of the skew correction and the lateral shift correction according to control by the stacker controller 701. FIG. 8 is a view illustrating a skew correcting operation in time series (following the direction of the arrows).

The two skew correction rollers 450*a* and 450*b* of the skew correction roller pair 450 perform the skew correcting operation based on the skew amount L6 detected by the side edge sensor 710. This operation is performed by changing the rotational speed of one of the skew correction motor (a) 722 and the skew correction motor (b) 723 (see FIG. 4) operating independently to drive the respective two rollers 450*a* and 450*b*.

When the sheet is detected to be in a skew toward the front side, the rotational speed of the skew correction motor (b) 723 corresponding to an advanced right-side portion of the sheet is reduced, whereby the speed of the skew correction roller 450*b* is decelerated. As a consequence, the advancing speed of the right-side portion of the sheet is slowed down relative to that of the left-side portion of the sheet, and the leading edge of the right-side portion and that of the left-side portion of the sheet are adjusted to a non-skewed state, whereby the skew of the sheet is corrected. The skew correction motor (b) 723 returns to its original speed in timing synchronous with elimination of the skew, whereby the skew correction roller 450*b* is accelerated to its original conveying speed. When the sheet is skewed in the opposite direction, i.e. in a skew toward the back side, the rotational speed of the skew correction motor (a) 722 is temporarily reduced to temporarily reduce the rotational speed of the skew correction roller 450*a*, whereby the skew of the sheet is corrected.

When the skew correction is completed, lateral shift correction is performed if required. The lateral shift correction is performed by the shift unit 470 including the shift conveying roller pair 451, as the shift unit 470 is driven by the shift motor 713 (see FIG. 5) and shifted in the lateral direction of the sheet. The shift unit 470 is shifted according to the lateral shift amount X detected by the side edge sensor 710, to thereby correct a lateral shift.

It should be noted that since the side edge sensor 710 is kept on standby in the standby position corresponding to a position indicative of no lateral shift amount, it is possible to employ a method in which the lateral shift correction is performed without using the lateral shift amount X. More specifically, at a time point when the side edge sensor 710 detects a sheet side edge after the start of a lateral shift-correcting operation, the shifting of the shift conveying roller pair 451 may be stopped to thereby complete the lateral shift correction.

Figure 9:
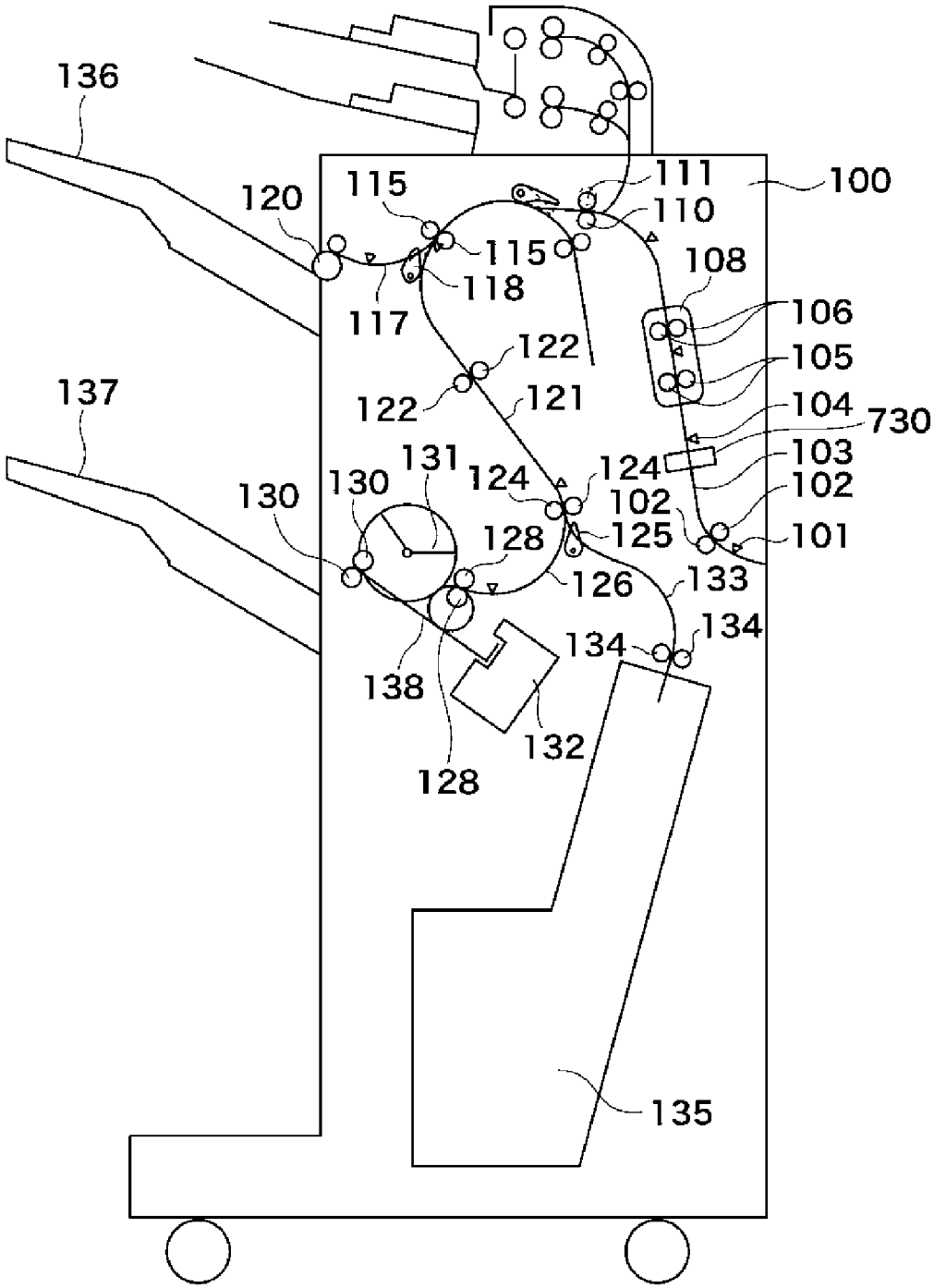
FIG. 9 is a longitudinal cross-sectional view of a finisher.

FIG. 9 is a longitudinal cross-sectional view of the finisher 100. A sheet discharged from the upstream sheet processing apparatus (the stacker 400 in the present example) is delivered to an inlet roller pair 102. At the same time, sheet delivery timing is detected by an inlet sensor 101. The sheet conveyed by the inlet roller pair 102 has the position of its side edge detected by the side edge sensor 104 while being conveyed along a conveying passage section 103. As a result, the amount of lateral shift of the sheet with respect to the center position of a conveying passage of the finisher 100 is detected.

The side edge sensor 104, which is controlled by the finisher controller 501, has the same construction as that of the side edge sensor 710 of the stacker 400. The side edge sensor 104 detects the lateral shift amount X and the skew amount L6 of a sheet in the finisher 100 by being controlled similarly to the side edge sensor 710. Disposed downstream of the side edge sensor 104 in the conveying passage is a shift unit 108. A hole-punching unit 730 is disposed between the conveying passage section 103 and the side edge sensor 104 along the conveying passage. The shift unit 108 includes shift roller pairs 105 and 106. The shift unit 108 can be shifted by a shift motor (not shown) in the sheet width direction orthogonal to the conveying direction. The shift unit 108 is shifted based on the lateral shift amount X detected by the side edge sensor 104, whereby the lateral shift correction is performed.

Figure 10:
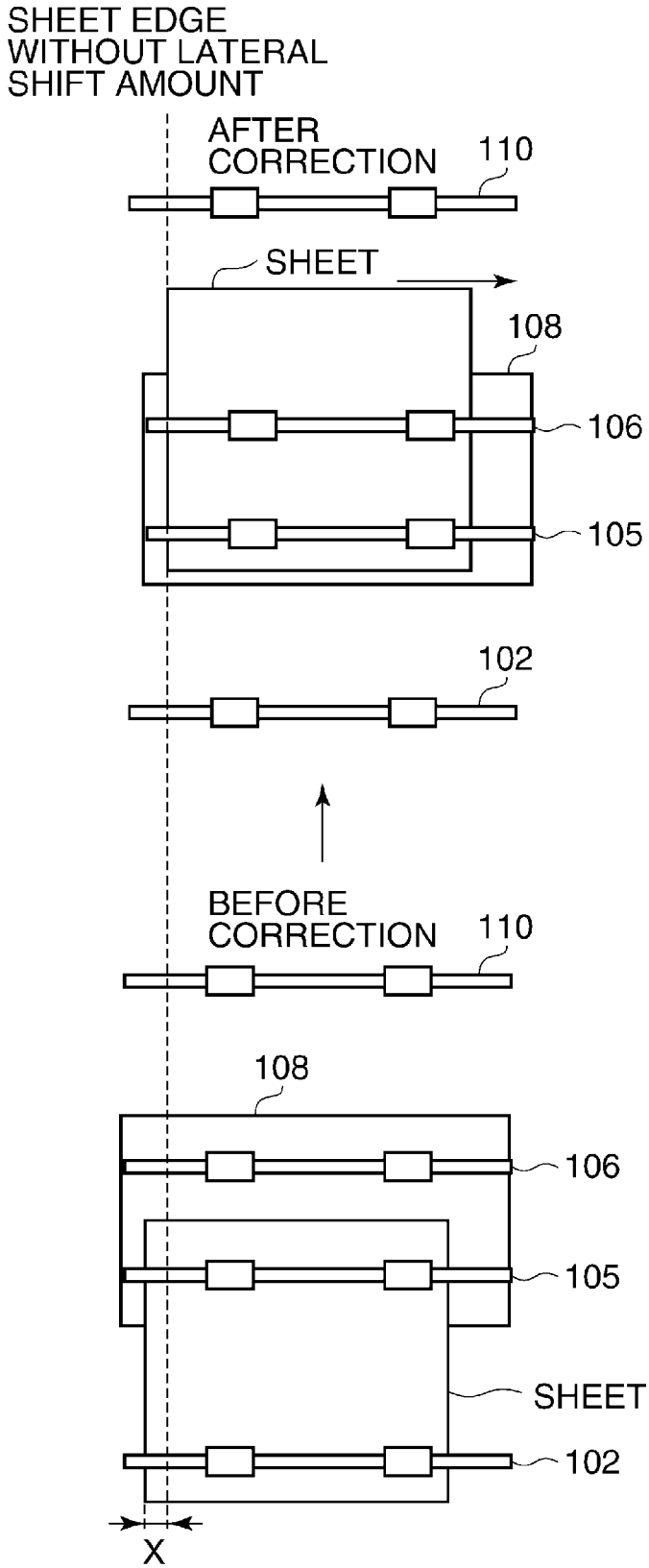
FIG. 10 illustrates lateral shift correction of a sheet by a shift unit.

FIG. 10 illustrate the lateral shift correction of a sheet by the shift unit 108. Assuming that a sheet shifted toward the front side (i.e. to the left when looking in the sheet conveying direction) has been conveyed, the side edge sensor 104 detects the frontward (leftward) lateral shift. The shift unit 108 shifts the sheet toward the back side (i.e. rightward as viewed in FIG. 10) according to the lateral shift amount X detected by the side edge sensor 104. More specifically, after the lateral shift has been detected, the shift unit 108 is shifted toward the right side during conveyance of the sheet by the shift roller pairs 105 and 106, whereby a sheet-shifting operation is performed to correct the lateral shift of the sheet. In a case where a sheet has a lateral shift in a direction opposite to the above-mentioned direction, the direction for shifting the sheet by the shift unit 108 is reversed.

Hereafter, when it is required to differentiate between the lateral shift amount X and the skew amount L6 detected in the stacker 400 and those detected in the finisher 100, "s" and "f" will be added to "X" and "L6". That is, the lateral shift amount and the skew amount detected in the stacker 400 will be denoted as "the lateral shift amount Xs" and "the skew amount L6*s*", and the lateral shift amount and the skew amount detected in the finisher 100 will be denoted as "the lateral shift amount Xf" and "the skew amount L6*f*".

In a case where the hole-punching unit 730 performs hole punching, the sheet is shifted to the center position by the shift unit 108. After the trailing edge of the sheet has passed through the punching unit 730, sheet conveyance is stopped. Thereafter, the sheet is subjected to switchback conveyance upstream, whereby its trailing edge is brought into abutment with an abutment member (not shown) of the punching unit 730. Then, the sheet is further conveyed by a predetermined distance and is then stopped. The reason why the sheet is further conveyed by the predetermined distance with its trailing edge held in abutment with the abutment member is that it is required to warp the sheet to correct a skew of the trailing edge of the sheet. In the state of the sheet being warped with its trailing edge held in abutment with the abutment member, a punch motor 524 (see FIG. 11) is driven, and the punching unit 730 punches the sheet. After completion of the punching, the shift unit 108 performs the sheet shifting operation again to shift the sheet toward the front (left) or the back (right) side by a predetermined distance for sheet sorting.

Thereafter, the sheet is conveyed to a buffer roller pair 115 by a conveying roller 110 and a separation roller 111 appearing in FIG. 9. When the sheet is to be discharged onto an upper tray 136, an upper path switching flapper 118 is switched by a drive unit (not shown), such as a solenoid. The sheet is guided into an upper path conveying passage 117 by the buffer roller pair 115 and is then discharged onto the upper tray 136 by an upper discharge roller 120.

On the other hand, when the sheet is not to be discharged onto the upper tray 136, the sheet conveyed by the buffer roller pair 115 is guided into a bundle conveying path 121 by the upper path switching flapper 118. Thereafter, the sheet is further conveyed along the bundle conveying path 121 by another buffer roller pair 122 and a bundle conveying roller pair 124.

When sheets are to be saddle-stitched, a saddle path switching flapper 125 is switched by a drive unit (not shown), such as a solenoid, whereby the sheets are sequentially conveyed into a saddle path 133. Then, each of them is guided to a saddle unit 135 by a saddle inlet roller pair 134, where they are saddle-stitched. The saddle-stitching is a general process, and therefore detailed description thereof is omitted.

When a sheet is to be discharged onto a lower tray 137, the sheet conveyed by the bundle conveying roller pair 124 is guided into a lower path 126 by the saddle path switching flapper 125. Thereafter, the sheet is discharged onto an intermediate processing tray 138 by a lower discharge roller pair 128. A return unit including a paddle 131 and a knurled belt (not shown) aligns a predetermined number of discharged sheets on the intermediate processing tray 138. Then, the sheets are stapled by a stapler 132, as required, followed by being discharged onto the lower tray 137 by a bundle discharge roller pair 130.

Figure 11:
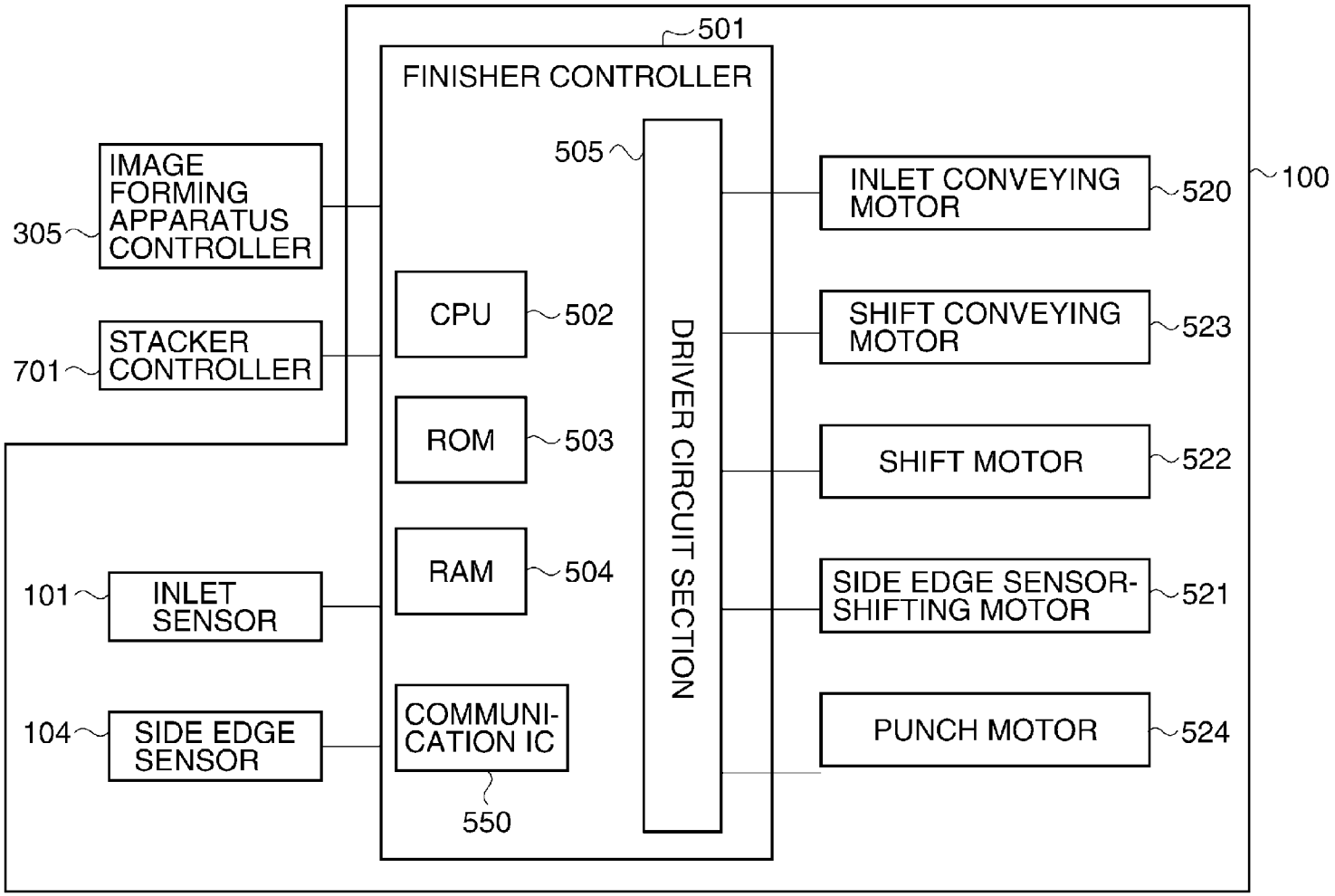
FIG. 11 is a block diagram of a control system of the finisher.

FIG. 11 is a block diagram of a control system of the finisher 100.

The finisher 100 includes the finisher controller 501. The finisher controller 501 comprises a CPU 502, a ROM 503, a RAM 504, the communication IC 550, and a driver circuit section 505. The finisher controller 501 is capable of communicating with the image forming apparatus controller 305 of the image forming apparatus 300 and the stacker controller 701 of the stacker 400 via the communication IC 550. Various actuators and sensors are controlled based on control programs stored in the ROM 503. More specifically, not only the inlet sensor 101 and the side edge sensor 104, but also an inlet conveying motor 520, a side edge sensor-shifting motor 521, a shift motor 522, a shift conveying motor 523, and the punch motor 524 are controlled by the finisher controller 501.

Next, a description will be given of processing for detecting the lateral shift amount X and the skew amount L6 and correcting a lateral shift and a skew, and hole-punching processing. First, with reference to FIGS. 21A and 21B and FIGS. 22A and 22B, a description will be given of how the stacker 400 corrects the lateral shift and skew of a sheet while taking into account the lateral shift amount Xf and skew amount L6*f* detected in the finisher 100, and then how the finisher 100 performs punching.

Figure 21A:
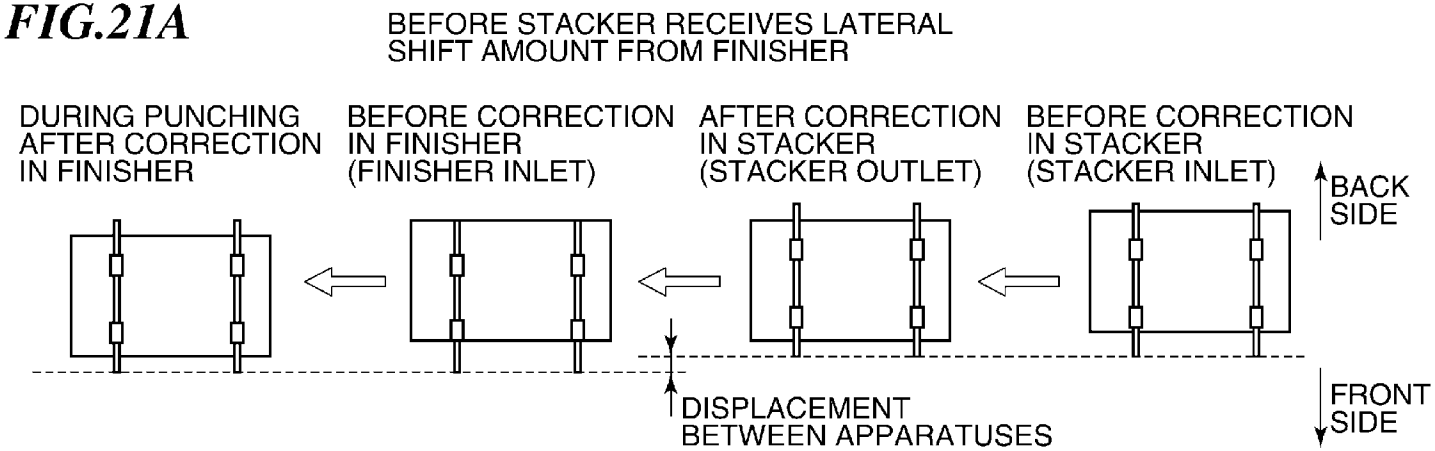
FIGS. 21A and 21B schematically illustrate the state of lateral shift of a sheet.
Figure 21B:
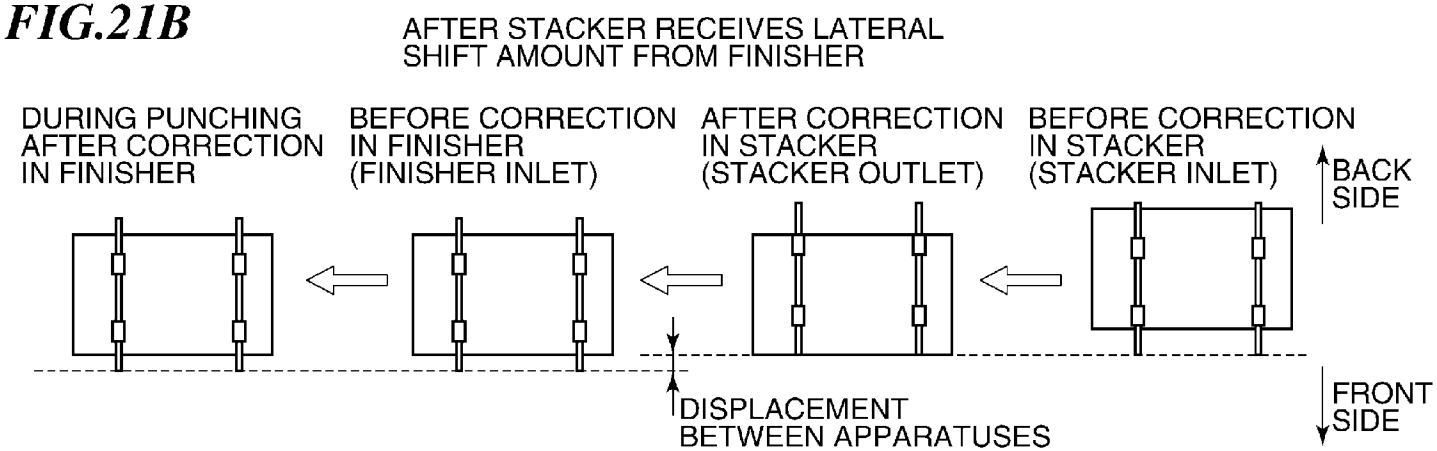
Figure 22A:
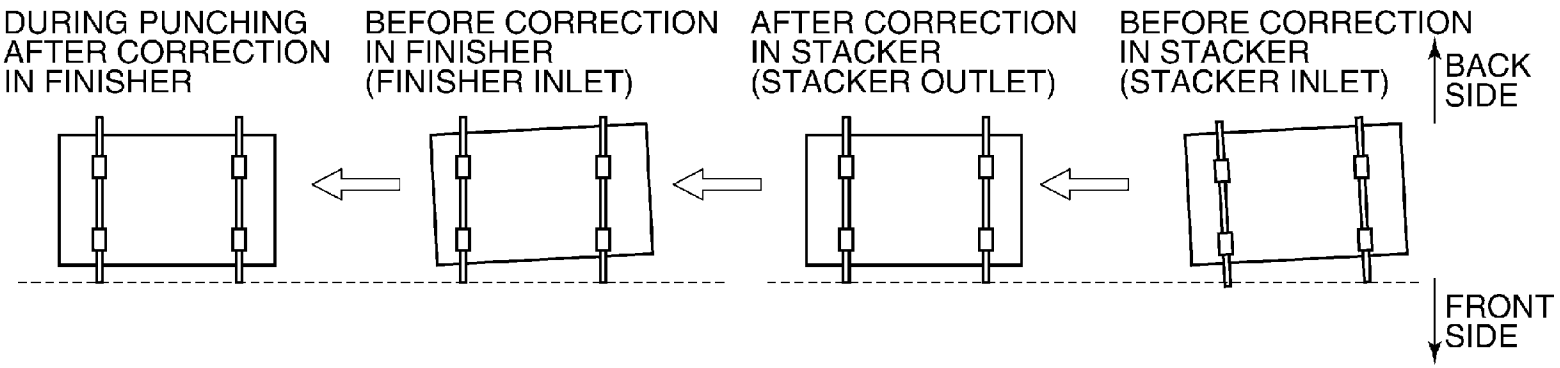
FIGS. 22A and 22B schematically illustrate the state of skew of a sheet.
Figure 22B:
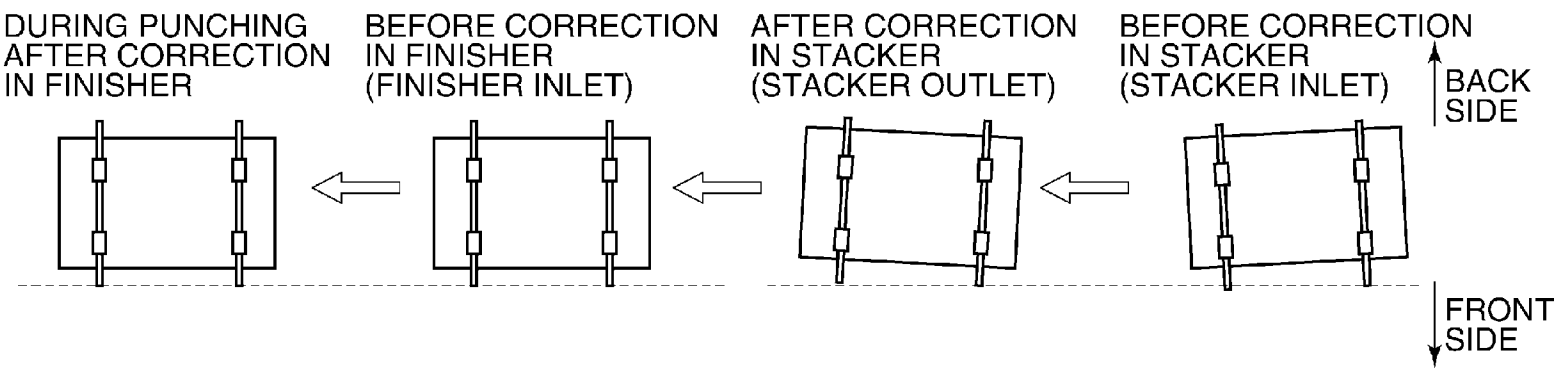
Figure 23A:
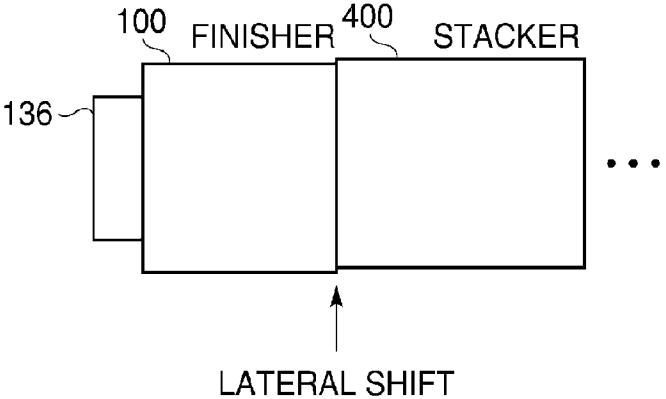
FIGS. 23A to 23D illustrate states of connection between apparatuses and states of lateral shift and skew of sheets.
Figure 23B:
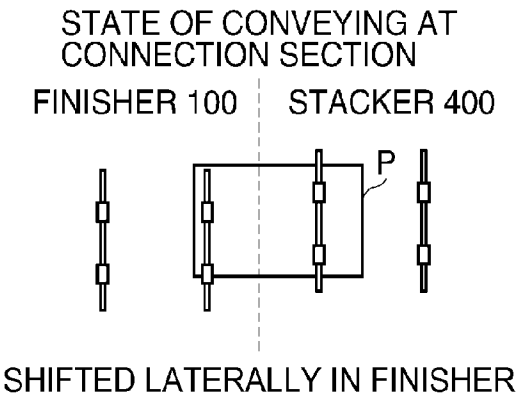
Figure 23C:
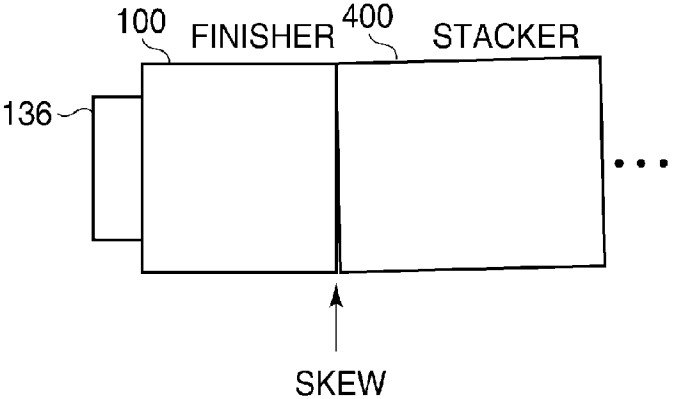
Figure 23D:
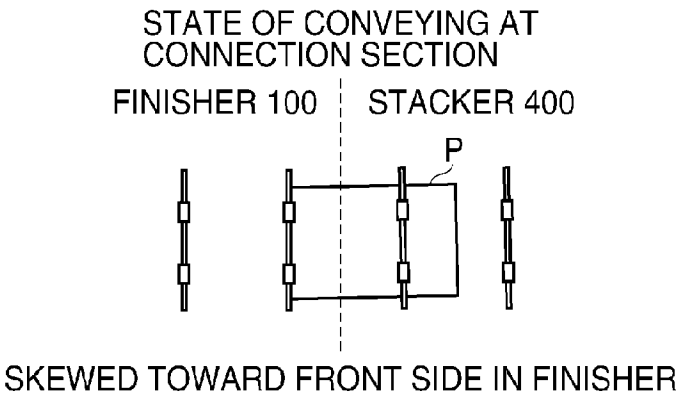

FIGS. 21A and 21B and 22A and 22B schematically illustrate the state of lateral shift of a sheet and the state of skew of a sheet from a time point when each sheet is conveyed into the stacker 400 to a time point when punching is performed by the finisher 100. Each of FIGS. 21A and 22A shows a case where lateral shift or skew of a sheet is corrected based on the lateral sheet amount Xs or the skew amount L6*s* detected in the stacker 400, irrespective of the lateral sheet amount Xf or the skew amount L6*f* detected in the finisher 100. These corrections will be referred to as "independent correction". On the other hand, each of FIGS. 21B and 22B show a case where lateral shift or skew of a sheet is corrected in the stacker 400 based on both the lateral sheet amount Xs and the lateral sheet amount Xf or both the skew amount L6*s* and the skew amount L6*f*. These corrections can be considered as feedback correction performed based on information on a lateral shift correction and a skew correction of a sheet which are executed earlier, and therefore the corrections will be referred to as "predictive correction".

Even in a case where a plurality of sheets are sequentially conveyed, the stacker 400 performs independent correction until information (data) of the lateral sheet amount Xf and the skew amount L6*f* detected in the finisher 100 is received. Therefore, a first sheet is generally subjected to independent correction shown in FIGS. 21A and 22A.

First, the lateral shift correction will be described. In FIGS. 21A and 21B, it is assumed that the stacker 400 is disposed in a manner displaced toward the back side of the apparatus (the right side when viewed in the sheet conveying direction or upward as viewed in FIGS. 21A and 21B) with respect to the finisher 100. FIG. 21A shows a lateral shift-correcting operation performed when the stacker 400 has not received lateral shift amount information from the finisher 100, whereas FIG. 21B shows a lateral shift-correcting operation performed when the stacker 400 has received lateral shift amount information from the finisher 100. As shown in FIG. 21A, when a first sheet conveyed into the stacker 400 is laterally shifted toward the back side, the lateral shift correction (independent correction) of the sheet is performed to bring the sheet to the center in the sheet width direction, followed by the sheet being discharged out of the stacker 400. When the sheet having undergone the lateral shift correction in the stacker 400 is conveyed into the finisher 100, a lateral shift of the sheet toward the back side is caused due to the displacement between the apparatuses.

In this case, when the lateral shift of the first sheet toward the back side (the sheet's right side) is detected in the finisher 100, the lateral shift correction of the sheet is performed to bring the sheet to the center in the sheet width direction, and then hole punching is performed. According to the present embodiment, upon detection of the lateral shift amount Xf of the first sheet in the finisher 100, the information of the lateral shift amount Xf (including shift direction information) is fed back to the stacker 400. More specifically, the information of the lateral shift amount Xf is sent to the stacker controller 701 of the stacker 400 via the communication IC 550 of the finisher controller 501. The stacker 400 receives the information via the communication IC 750 of the stacker controller 701. This effectively enables feedback correction of the sheet position as shown in FIG. 21B.

Before the information of the lateral shift amount Xf is received, the stacker 400 performs the independent correction on each sheet conveyed into the stacker 400. On the other hand, for a sheet conveyed into the stacker 400 after receiving the information of the lateral shift amount Xf, it is possible to perform the lateral shift correction as the predictive correction by taking the lateral shift amount Xf into account. In the predictive correction (lateral shift correction) performed in the stacker 400, the lateral shift toward the back side in the finisher 100 is taken into account, based on the information that the first sheet was in a state shifted toward the back side when it was conveyed into the finisher 100, and the amount of correction toward the front side is increased. More specifically, as shown in FIG. 21B, control is performed such that a sheet is conveyed out of the stacker 400 in a state not in the center but shifted toward the front side from the center, and is conveyed into the finisher 100 in a state positioned in the center. This makes it possible for the finisher 100 to receive the sheet with little or no lateral shift.

Next, the skew correction will be described. In FIGS. 22A and 22B, it is assumed that the stacker 400 is connected to—and angularly displaced from—the finisher 100. FIG. 22A shows a skew-correcting operation performed when the stacker 400 has not received skew amount information from the finisher 100, whereas FIG. 22B shows a skew-correcting operation performed when the stacker 400 has received skew amount information from the finisher 100. Each of FIGS. 22A and 22B shows an exemplary case where a sheet is more skewed toward the front side of the apparatuses (left side of the sheet viewed in the sheet conveying direction) at a time point when the sheet is conveyed into the finisher 100 than at a time point when the sheet is conveyed out of the stacker 400.

As shown in FIG. 22A, in a case where a first sheet conveyed into the stacker 400 is in a skew toward the front side, the skew correction (independent correction) is performed on the sheet to correct the skew of the sheet, followed by the sheet being conveyed out. When the sheet, having undergone the skew correction in the stacker 400, is conveyed into the finisher 100, a skew of the sheet toward the front side is caused due to the angular displacement between the apparatuses.

In the finisher 100, the skew of the first sheet is corrected, and then punching is performed on the sheet. Further, at a time point when the skew amount L6*f* of the first sheet is detected in the finisher 100, the information of the skew amount L6*f* (including skew direction information) is sent to the stacker 400 similarly to the lateral shift amount Xf.

Before receiving the information of the skew amount L6*f*, the stacker 400 performs the independent correction on each sheet conveyed into the stacker 400. On the other hand, as for a sheet conveyed into the stacker 400 after receiving the information of the skew amount L6*f*, it is possible to perform the skew correction as the predictive correction by taking the skew amount L6*f* into account.

In the predictive correction (skew correction) performed in the stacker 400, information that the first sheet was in a skew toward the front side when it was conveyed into the finisher 100 is taken into account, and the amount of skew correction toward the back side is increased. More specifically, as shown in FIG. 22B, control is performed such that a sheet is conveyed out of the stacker 400 not straight but in a state skewed toward the back side. As a consequence, the sheet is conveyed into the finisher 100 straight without any skew.

As described above, in the stacker 400, the lateral shift correction is performed by taking into account both the lateral shift amount Xs and the lateral shift amount Xf, and similarly, the skew correction is performed by taking into account both the skew amount L6*s* and the skew amount L6*f*. This makes it possible to reduce or eliminate the amounts of lateral shift correction and skew correction which are required to be executed by the finisher 100. Thus, the lateral shift and skew of a sheet in the finisher 100 are reduced, which reduces time required to perform the sheet position correction before hole-punching.

If the values of the lateral shift amounts Xs and Xf and the skew amounts L6*s* and L6*f* become stable without being varied, it is possible to configure a process for lateral shift correction and skew correction such that the finisher 100 is no longer required to perform lateral shift correction or skew correction on a sheet having undergone predictive correction in the stacker 400.

In the present example, based on the information of the lateral shift amount Xf and the skew amount L6*f* of the first sheet, the predictive correction is performed on subsequent sheets. However, a method may be employed in which the independent correction is performed on a plurality of sheets, and then the predictive correction is performed on a subsequent sheet group using the average values of the lateral shift amounts Xf and the skew amounts L6*f* of the preceding sheets.

Figure 12:
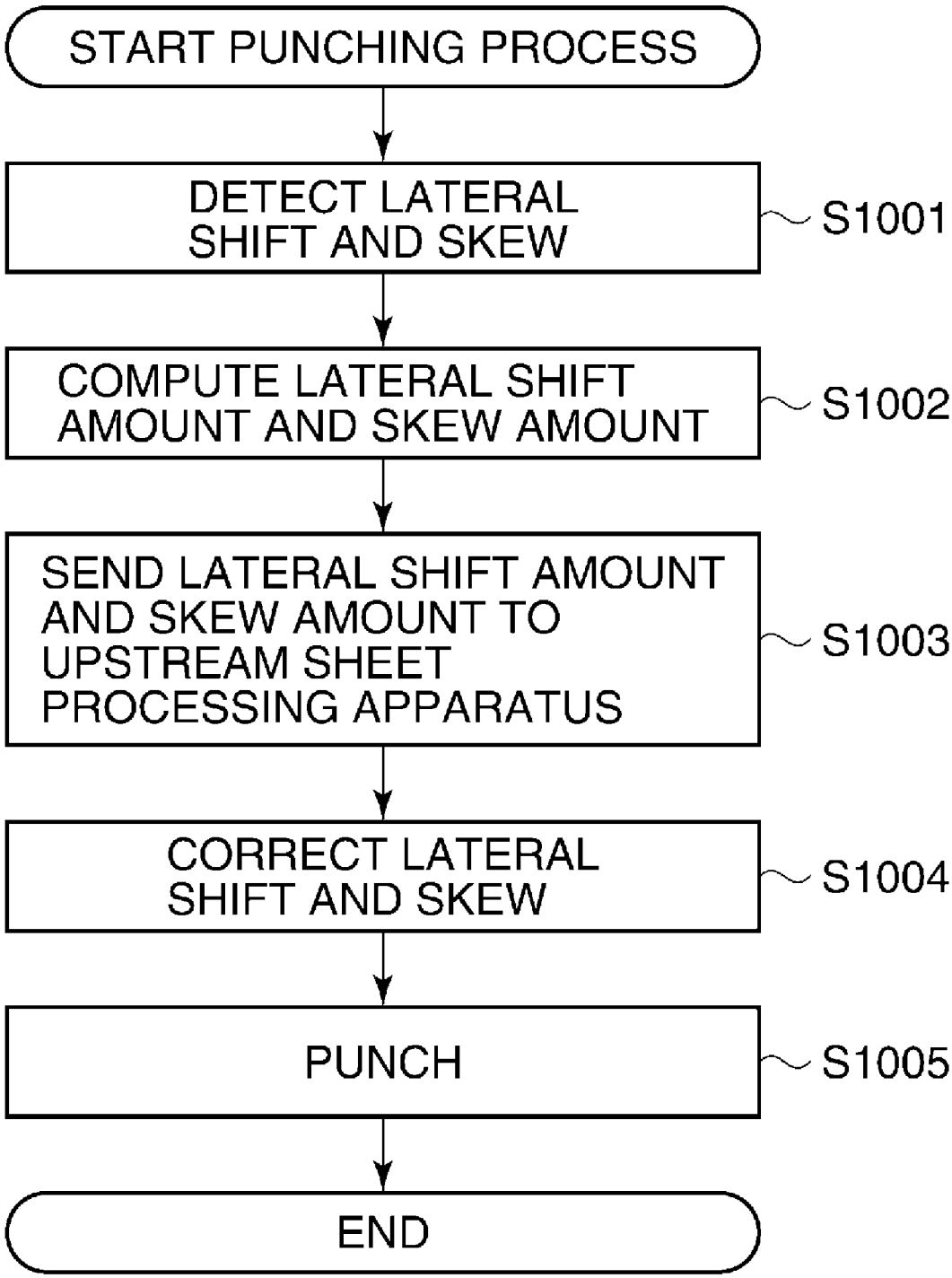
FIG. 12 is a flowchart of a hole-punching process executed by a finisher controller.

FIG. 12 is a flowchart of a punching process executed by the finisher controller 501 of the finisher 100 connected downstream of the stacker 400. First, the finisher controller 501 controls the side edge sensor 104 to detect a positional error such as lateral shift and skew of a sheet conveyed into the finisher 100 (step S1001). Next, the finisher controller 501 computes the lateral shift amount Xf and the skew amount L6*f* based on the result of the detection by the side edge sensor 104, by the equations (1) and (2) (step S1002). Then, the finisher controller 501 sends the information of the lateral shift amount Xf and the skew amount L6*f* computed as above, via the communication IC 550, to the stacker 400 as a sheet processing apparatus connected upstream of the finisher 100 (step S1003). The stacker 400, having received the lateral shift amount Xf and the skew amount L6*f*, performs lateral shift correction and skew correction on sheets conveyed into the stacker 400, based on the received information.

Next, the finisher controller 501 performs the lateral shift correction and skew correction (step S1004). More specifically, the finisher controller 501 controls the shift unit 108 to perform the lateral shift correction and skew correction based on the lateral shift amount Xf and the skew amount L6*f* which are detected anew. Further, before hole-punching is performed, the sheet is brought into abutment with the abutment member, whereby a skew of a trailing edge of the sheet to be punched is corrected. Then, the finisher controller 501 controls the hole-punching unit 730 to punch the corrected sheet (step S1005), followed by terminating the present process.

Figure 13:
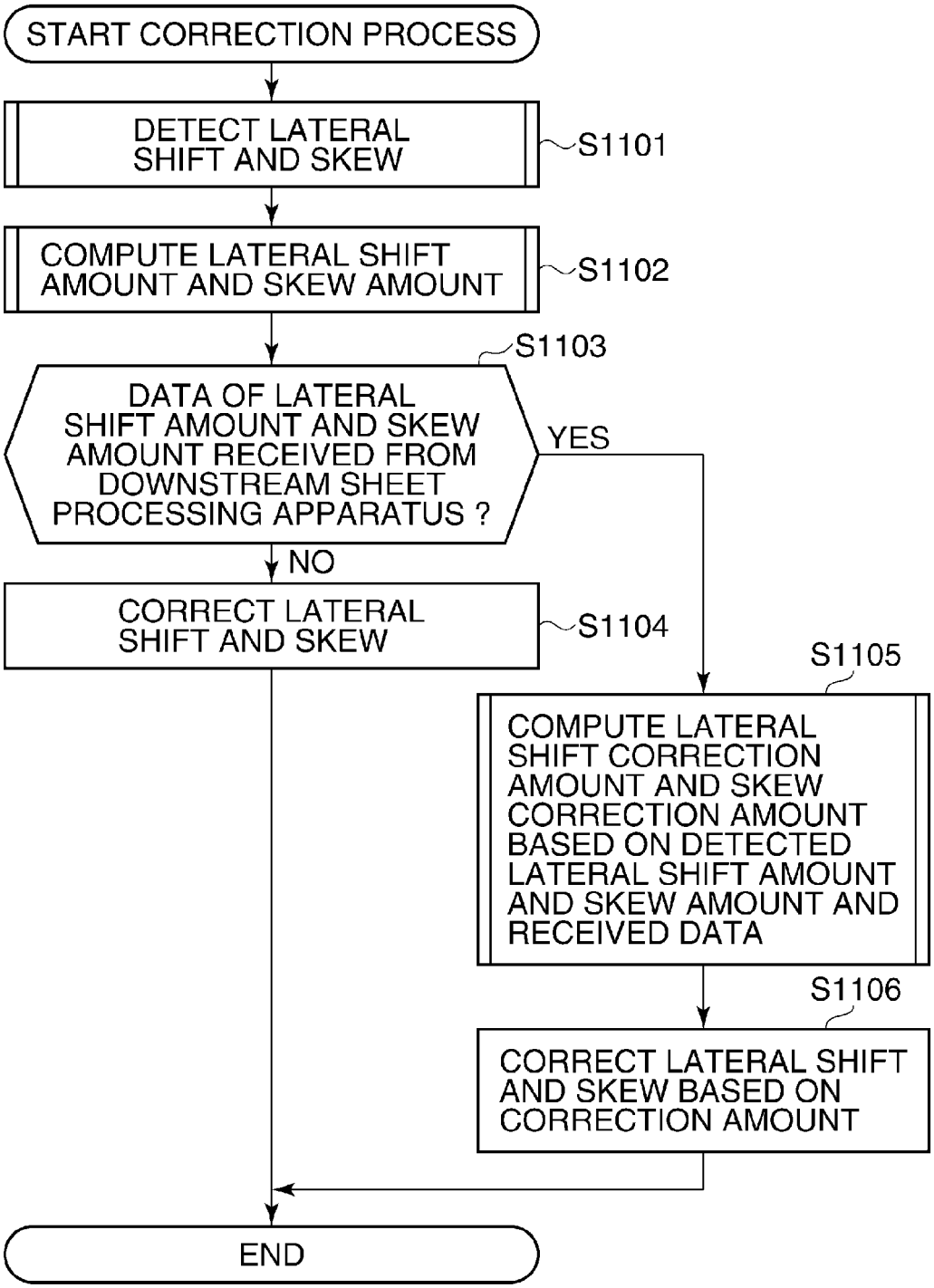
FIG. 13 is a flowchart of a correction process executed by a stacker controller.

FIG. 13 is a flowchart of a correction process executed by the stacker controller 701 of the stacker 400. First, the stacker controller 701 controls the side edge sensor 710 to detect lateral shift and skew of a sheet conveyed into the stacker 400 (step S1101). Next, the stacker controller 701 computes the lateral shift amount Xs and the skew amount L6*s* based on the result of the detection by the side edge sensor 710 (step S1102). Processing executed in the steps S1101 and S1102 will be described hereinafter.

Then, the stacker controller 701 determines whether or not data of the lateral shift amount Xf and the skew amount L6*f* computed in the finisher 100 has been received, via the communication IC 750, from the finisher 100 connected downstream of the stacker controller 701 (step S1103). If the data has not been received, the stacker controller 701 performs the lateral shift correction and skew correction based on the lateral shift amount Xs and the skew amount L6*s* computed in the step S1102 (step S1104). More specifically, the stacker controller 701 controls the shift unit 470 to perform the lateral shift correction and controls the skew correction roller pair 450 to perform the skew correction. After execution of the step S1104, the present process is terminated.

On the other hand, if it is determined in the step S1103 that the data has been received, the process proceeds to a step S1105, wherein the stacker controller 701 computes a lateral shift correction amount D1 based on the computed lateral shift amount Xs and the received lateral shift amount Xf. At the same time, the stacker controller 701 computes a skew correction amount D2 based on the computed skew amount L6*s* and the received skew amount L6*f*. The computation of the lateral shift correction amount D1 and the skew correction amount D2 will be described hereinafter. The lateral shift correction amount D1 and the skew correction amount D2 are temporarily stored.

Then, in a step S1106, the stacker controller 701 performs the lateral shift correction and the skew correction as the above-described predictive correction, based on the lateral shift correction amount D1 and the skew correction amount D2 computed in the step S1105, on each of sheets that sequentially reach the stacker 400 after the reception of the data from the finisher 100. More specifically, the stacker controller 701 controls the shift unit 470 to perform the lateral shift correction and controls the skew correction roller pair 450 to perform the skew correction. After execution of the step S1106, the present process is terminated.

Figure 14:
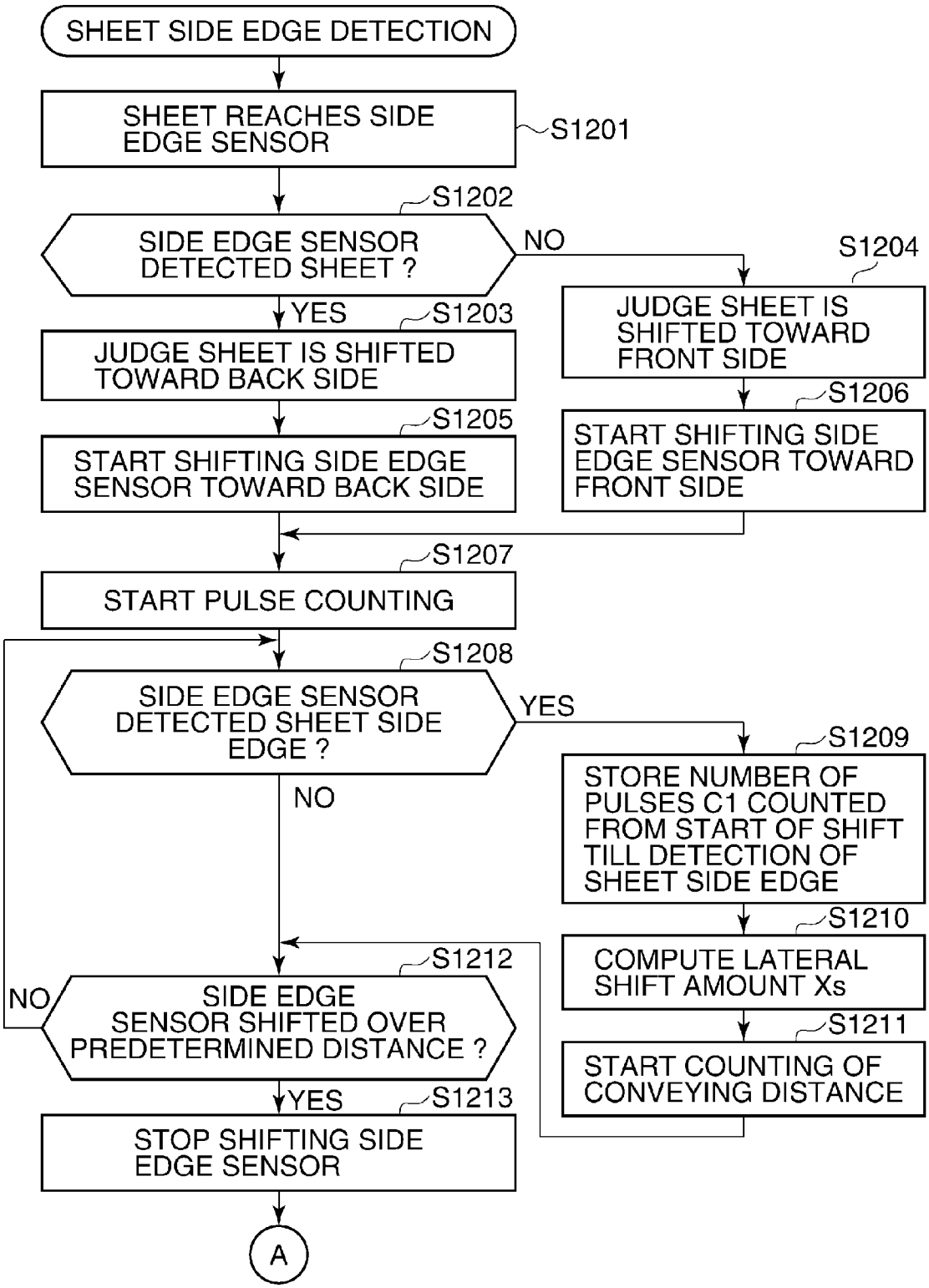
FIG. 14 is a flowchart of a sheet side edge-detecting process for detecting and calculating a lateral shift amount and a skew amount.
Figure 15:
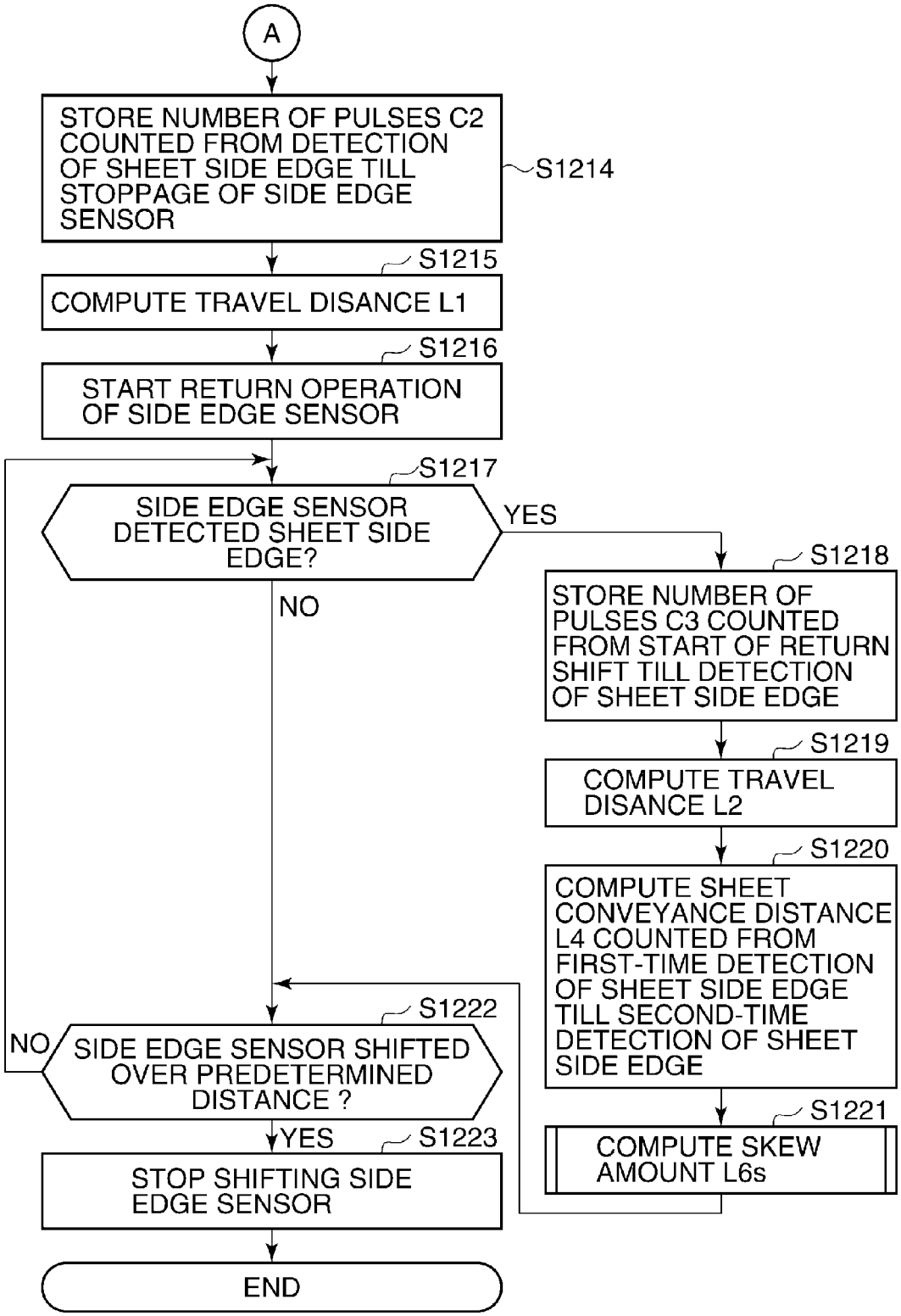
FIG. 15 is a continuation of FIG. 14.

FIGS. 14 and 15 are a flowchart of a sheet side edge-detecting process executed by the stacker controller 701. This process corresponds to the processes executed in the steps S1101 and S1102 in FIG. 13 for detecting and calculating a lateral shift amount and a skew amount.

When a sheet is conveyed and reaches the position facing the side edge sensor 710, the stacker controller 701 starts detection of a side edge of the sheet (step S1201). First, the stacker controller 701 determines whether or not the side edge sensor 710 in the standby position has detected the sheet (step S1202). If the side edge sensor 710 has detected the sheet, the stacker controller 701 judges that the sheet has been laterally shifted toward the back side (step S1203), and starts shifting the side edge sensor 710 toward the back side (step S1205). On the other hand, if the side edge sensor 710 has not detected the sheet, the stacker controller 701 judges that the sheet has been laterally shifted toward the front side of the apparatus (step S1204; see the example illustrated in FIGS. 6A to 6F), and starts shifting the side edge sensor 710 toward the front side (step S1206).

Then, in a step S1207, the stacker controller 701 starts counting the number of pulses from the side edge sensor-shifting motor 714. Next, the stacker controller 701 determines whether or not the side edge of the sheet has been detected by the side edge sensor 710 (step S1208). If the sheet side edge has not been detected, the stacker controller 701 determines whether or not the side edge sensor 710 has been shifted over a predetermined distance after it started moving in a forward direction (step S1212). On the other hand, if the sheet side edge has been detected, the stacker controller 701 stores the number of pulses from the side edge sensor-shifting motor 714, which was counted over a time period from the time point when the side edge sensor 710 started a forward motion to the time point when the sheet side edge was detected (step S1209). At this time, the number of pulses is stored not only as a pulse count p, but also as the pulse count C1 (see FIGS. 7A and 7B). These pulse counts are stored e.g. in the RAM 704.

Then, the stacker controller 701 not only computes the lateral shift amount Xs from the pulse count p by the equation (1) (step S1210), but also starts counting a sheet conveying distance (step S1211), and then executes the step S1212. If the stacker controller 701 determines in the step S1212 that the side edge sensor 710 has not been shifted over the predetermined distance, the process returns to the step S1208. On the other hand, if the side edge sensor 710 has been shifted over the predetermined distance, the stacker controller 701 stops the shift of the side edge sensor 710 (step S1213).

Next, in a step S1214 in FIG. 15, the stacker controller 701 stores the pulse count C2 indicative of the number of pulses from the side edge sensor-shifting motor 714, which was counted in the forward stroke of the side edge sensor 710 over a time period from the time point when the sheet side edge was detected to the time point when the shift of the side edge sensor 710 was stopped. Then, the stacker controller 701 computes the travel distance L1 from the pulse count C1 stored in the step S1209 or the pulse count C2 stored in the step S1214 (step S1215). More specifically, in the exemplary cases shown in FIGS. 7A and 7B, the travel distance L1 is computed from the pulse counts C2 and C1, respectively, as described hereinabove.

Next, the stacker controller 701 causes the side edge sensor 710 to start a return operation (step S1216). Then, the stacker controller 701 determines whether or not the sheet side edge has been detected by the side edge sensor 710 (step S1217). If the sheet side edge has not been detected, the stacker controller 701 determines whether or not the side edge sensor 710 has been shifted over a predetermined distance (step S1222). On the other hand, if the sheet side edge has been detected, the stacker controller 701 stores the pulse count C3 indicative of the number of pulses from the side edge sensor-shifting motor 714, which was counted over a time period from the time point when the side edge sensor 710 started the return operation to the time point when the sheet side edge was detected again (step S1218). Then, the stacker controller 701 computes the travel distance L2 from the stored pulse counts C1 and C2 and the pulse count C3 stored in the step S1218 (step S1219). More specifically, as described above, in the exemplary case in FIG. 7A, the travel distance L2 is computed from the pulse count C3, while in the exemplary case in FIG. 7B, the travel distance L2 is computed from a pulse count determined by (C1+C2−C3).

Next, the stacker controller 701 computes the travel distance L4 corresponding to a sheet conveying distance counted over a time period from the first-time detection of the sheet side edge in the step S1208 to the second-time detection of the same in the step S1217 (step S1220). Then, the stacker controller 701 computes the skew amount L6*s* by a process described hereinafter (step S1221), and then proceeds to the step S1222. In the step S1222, the stacker controller 701 determines whether or not the side edge sensor 710 has been shifted over a predetermined distance after the start of the return operation. If the stacker controller 701 determines that the side edge sensor 710 has not been shifted over the predetermined distance, the process returns to the step S1217. On the other hand, if the side edge sensor 710 has been shifted over the predetermined distance, which means that the side edge sensor 710 has returned to the standby position, the stacker controller 701 stops the shifting of the side edge sensor 710 (step S1223), followed by terminating the present process.

Figure 16:
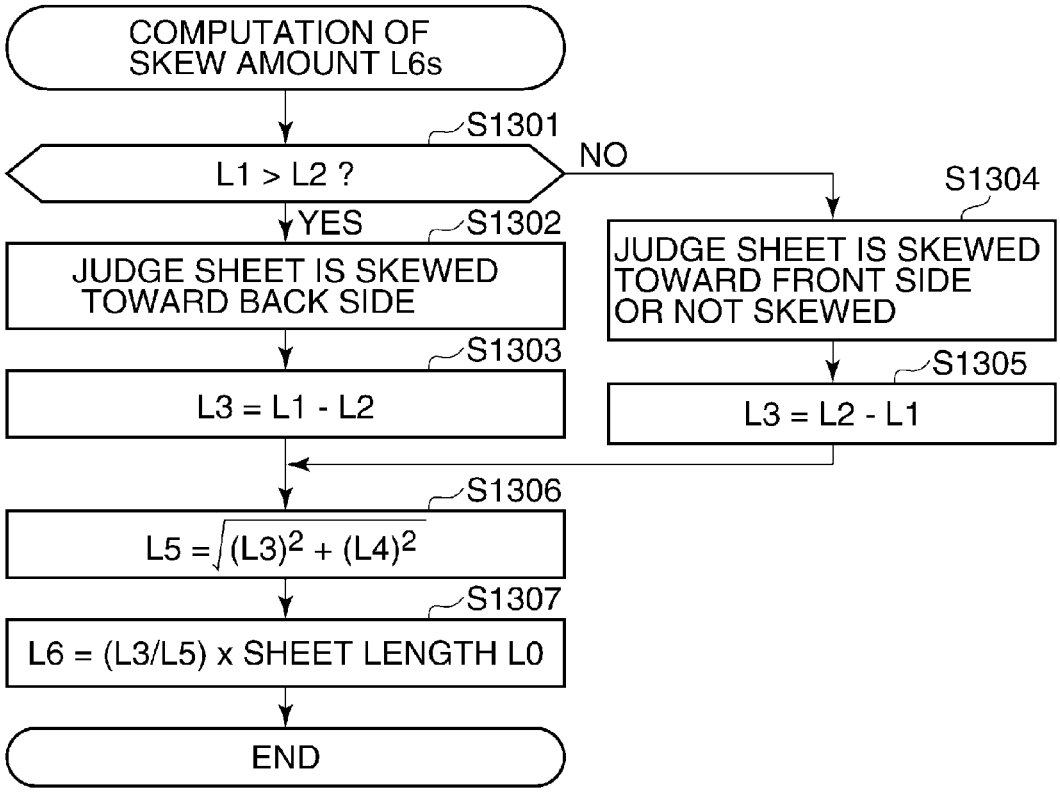
FIG. 16 is a flowchart of a skew amount-calculating process.

FIG. 16 is a flowchart of details of the skew amount-calculating process executed in the step S1221 of the sheet side edge-detecting process in FIG. 15. First, the stacker controller 701 performs comparison in magnitude between the travel distance L1 computed in the step S1215 in FIG. 15 and the travel distance L2 computed in the step S1219 in FIG. 15, to determine whether or not L1>L2 holds (step S1301). If L1>L2 holds, the stacker controller 701 judges that the sheet is skewed toward the back side (step S1302), and computes the difference L3 by an equation of L3=L1−L2 (step S1303). On the other hand, if L1>L2 does not hold, the stacker controller 701 judges that the sheet is skewed toward the front side or not skewed (step S1304), and computes the difference L3 by the equation of L3=L2−L1 (step S1305). It should be noted that the steps S1303 and S1305 may be integrated into a single step where an arithmetic operation of L3=|L2−L1| is performed.

Next, the stacker controller 701 computes the hypotenuse length L5 (see FIGS. 7A and 7B) from the difference L3 and the sheet conveyance distance L4 obtained in the step S1220 in FIG. 15, by the equation of $L5=\sqrt{\{(L3)^2+(L4)^2\}}$ (step S1306). Then, the stacker controller 701 computes the skew amount L6*s* from the difference L3, the hypotenuse length L5, and the sheet length L0 (see FIGS. 7A and 7B) by the equation (2) (step S1307), followed by terminating the present process.

In the present embodiment, the sheet side edge-detecting mechanism of the stacker 400 and that of the finisher 100 are basically identical in construction. For this reason, the sheet side edge-detecting process (detection of a lateral shift and a skew and computation of a lateral shift amount and a skew amount) by the stacker controller 701 and that by the finisher controller 501 are carried out in the same manner in the stacker 400 and the finisher 100, respectively. Therefore, the details of the sheet side edge-detecting process which the finisher 100 executes in the steps S1001 and S1002 in FIG. 12 are identical to those of the processes described in the steps S1101 and S1102 in FIG. 13 as processing executed by the stacker 400.

Figure 17:
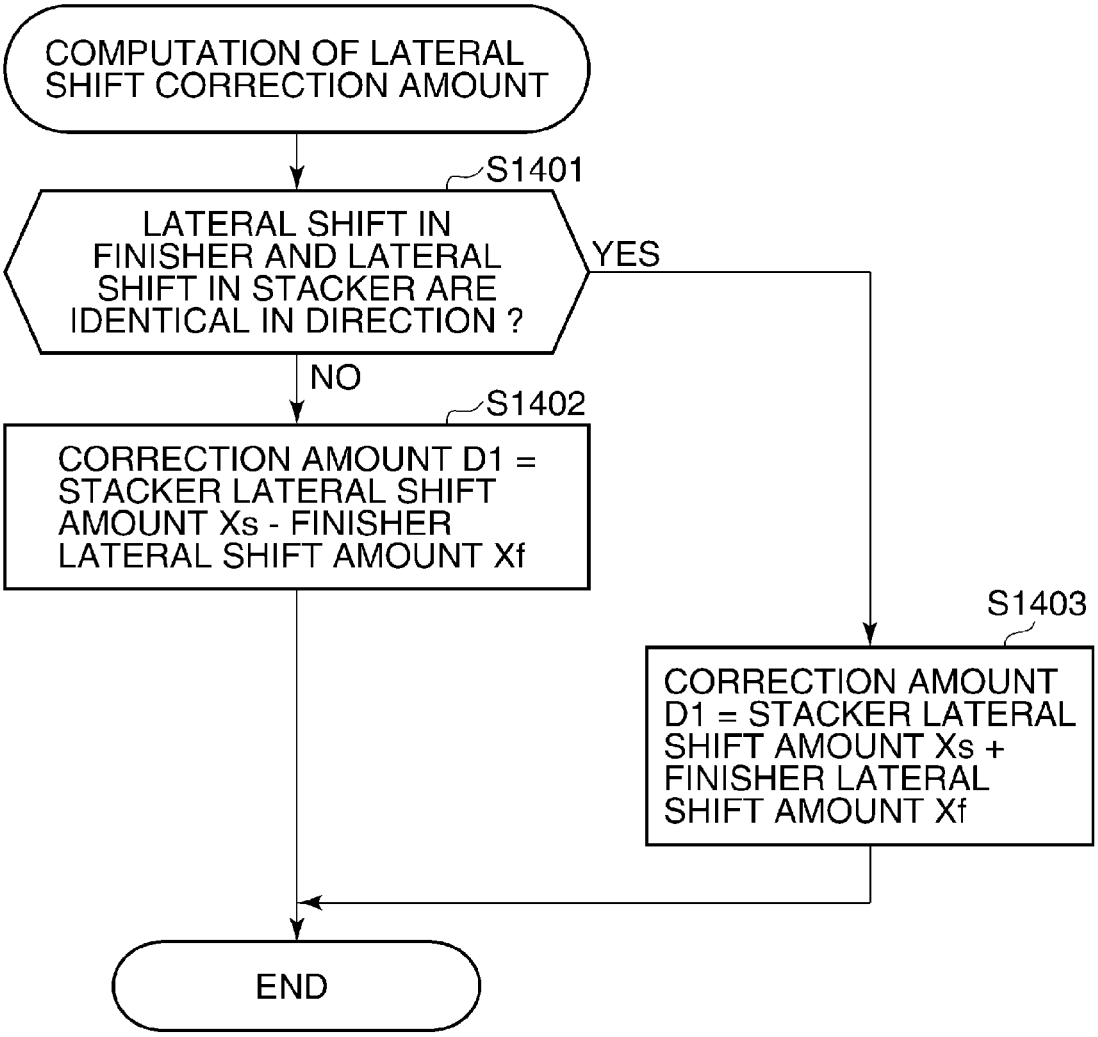
FIG. 17 is a flowchart of a lateral shift correction amount-calculating process.

FIG. 17 is a flowchart of the lateral shift correction amount-calculating process executed in the step S1105 in FIG. 13. This process is executed by the stacker controller 701 after the stacker 400 has received the information of the lateral shift amount Xf from the finisher 100 connected downstream of the stacker 400. First, the stacker controller 701 determines whether or not the lateral shift amount Xf in the finisher 100 and the lateral shift amount Xs in the stacker 400 have the same shift direction (step S1401). Here, the lateral shift amount Xf in the step S1401 is the same as the lateral shift amount Xf determined to have been received in the step S1103 in FIG. 13. The lateral shift amount Xs is the same as the lateral shift amount Xs computed in the step S1210 in FIG. 14. Whether or not the two lateral shift amounts Xf and Xs are identical in shift direction is determined based on shift direction information attached to each of the lateral shift amounts Xf and Xs. If the two lateral shift amounts Xf and Xs have different shift directions, the stacker controller 701 computes the lateral shift correction amount D1 by an equation of D1=Xs−Xf (step S1402). In this case, the direction of lateral shift correction performed in the step S1106 in FIG. 13 is not always the same as the direction of correction of the lateral shift amount Xs in the stacker 400.

On the other hand, if it is determined in the step S1401 that the lateral shift amount Xf and the lateral shift amount Xs have the same shift direction, the stacker controller 701 computes the lateral shift correction amount D1 by the equation of D1=Xs+Xf (step S1403). In this case, the direction of lateral shift correction performed in the step S1106 in FIG. 13 is the same as the direction of correction of the lateral shift amount Xs in the stacker 400. After executing the step S1402 or S1403, the present process is terminated.

As described above, in the FIG. 17 process, the lateral shift correction amount D1 is computed by incorporating a correction amount for compensating for the lateral shift amount Xf into a correction amount for compensating for the lateral shift amount Xs.

Figure 18:
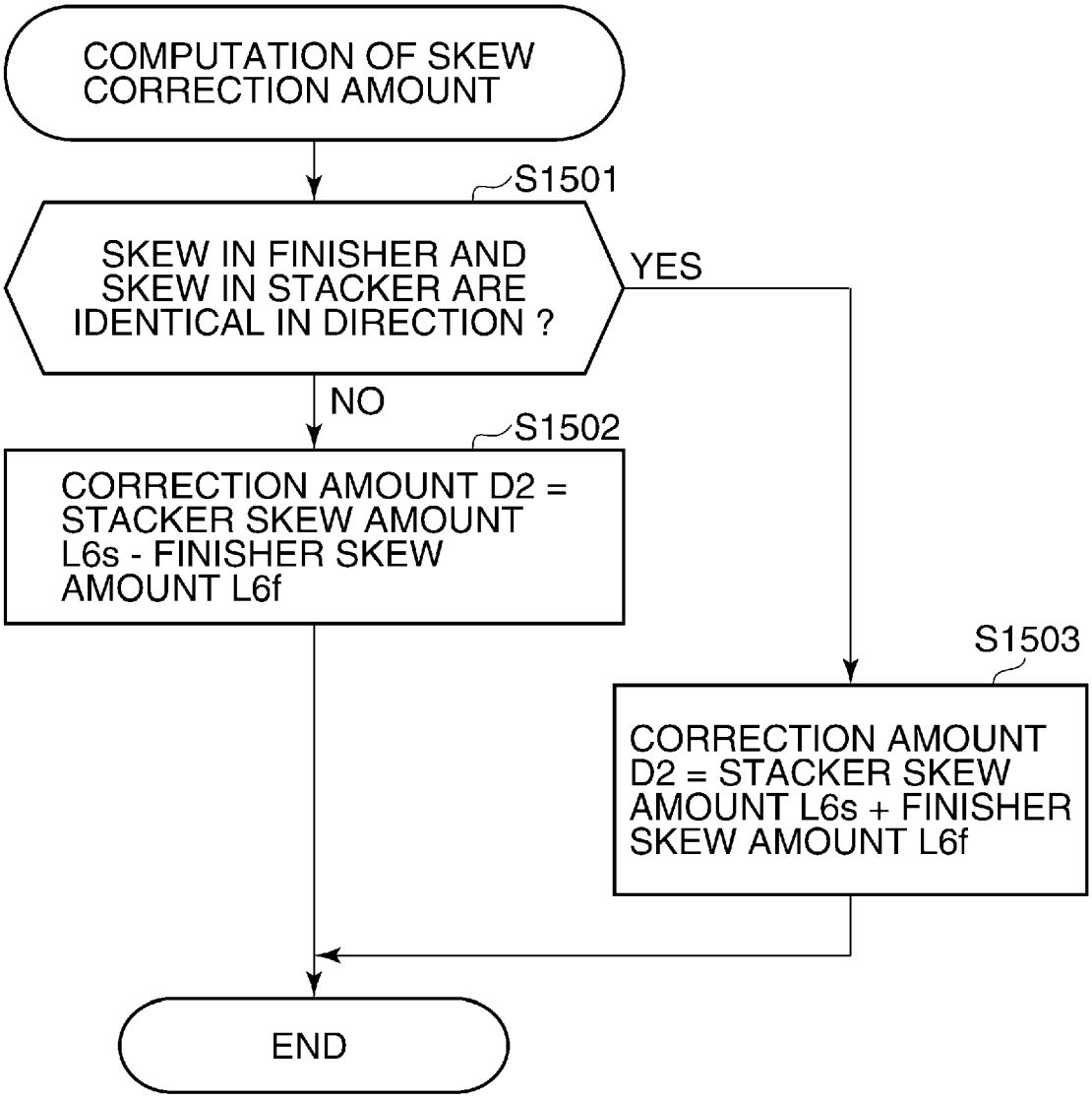
FIG. 18 is a flowchart of a skew correction amount-calculating process.

FIG. 18 is a flowchart of the skew correction amount-calculating process executed in the step S1105 in FIG. 13. This process is executed by the stacker controller 701 after the stacker 400 has received the information of the skew amount L6*f* from the finisher 100 connected downstream of the stacker 400. First, the stacker controller 701 determines whether or not the skew amount L6*f* in the finisher 100 and the skew amount L6*s* in the stacker 400 have the same skew direction (step S1501). The skew amount L6*f* in the step S1501 is the same as the skew amount L6*f* determined to have been received in the step S1103 in FIG. 13. The skew amount L6*s* is the same as the skew amount L6*s* computed in the step S1221 in FIG. 15. Whether or not the two skew amounts L6*f* and L6*s* have the same skew direction is determined based on skew direction information attached to each of the skew amounts L6*f* and L6*s*. If the two skew amounts L6*f* and L6*s* have different shift directions, the stacker controller 701 computes the skew correction amount D2 by the equation of D2=L6*s*−L6*f* (step S1502). In this case, the direction of skew correction performed in the step S1106 in FIG. 13 is not always the same as the direction of correction of the skew amount L6*s* in the stacker 400.

On the other hand, if it is determined in the step S1501 that the skew amount L6*f* and the skew amount L6*s* have the same skew direction, the stacker controller 701 computes the skew correction amount D2 by the equation of D2=L6*s*+L6*f* (step S1503). In this case, the direction of skew correction performed in the step S1106 in FIG. 13 is the same as the direction of correction of the skew amount L6*s* in the stacker 400. After executing the step S1502 or S1503, the present process is terminated.

As described above, in the FIG. 18 process, the skew correction amount D2 is computed by incorporating a correction amount for compensating for the skew amount L6*f* into a correction amount for compensating for the skew amount L6*s*.

Next, with reference to FIGS. 19 and 20, a description will be given of an operation performed by the image forming apparatus 300 to change a sheet interval according to an instruction from the stacker 400, depending on whether or not the stacker 400 currently performs the predictive correction by taking into account the lateral shift amount Xf and the skew amount L6*f* in the finisher 100.

Figure 19:
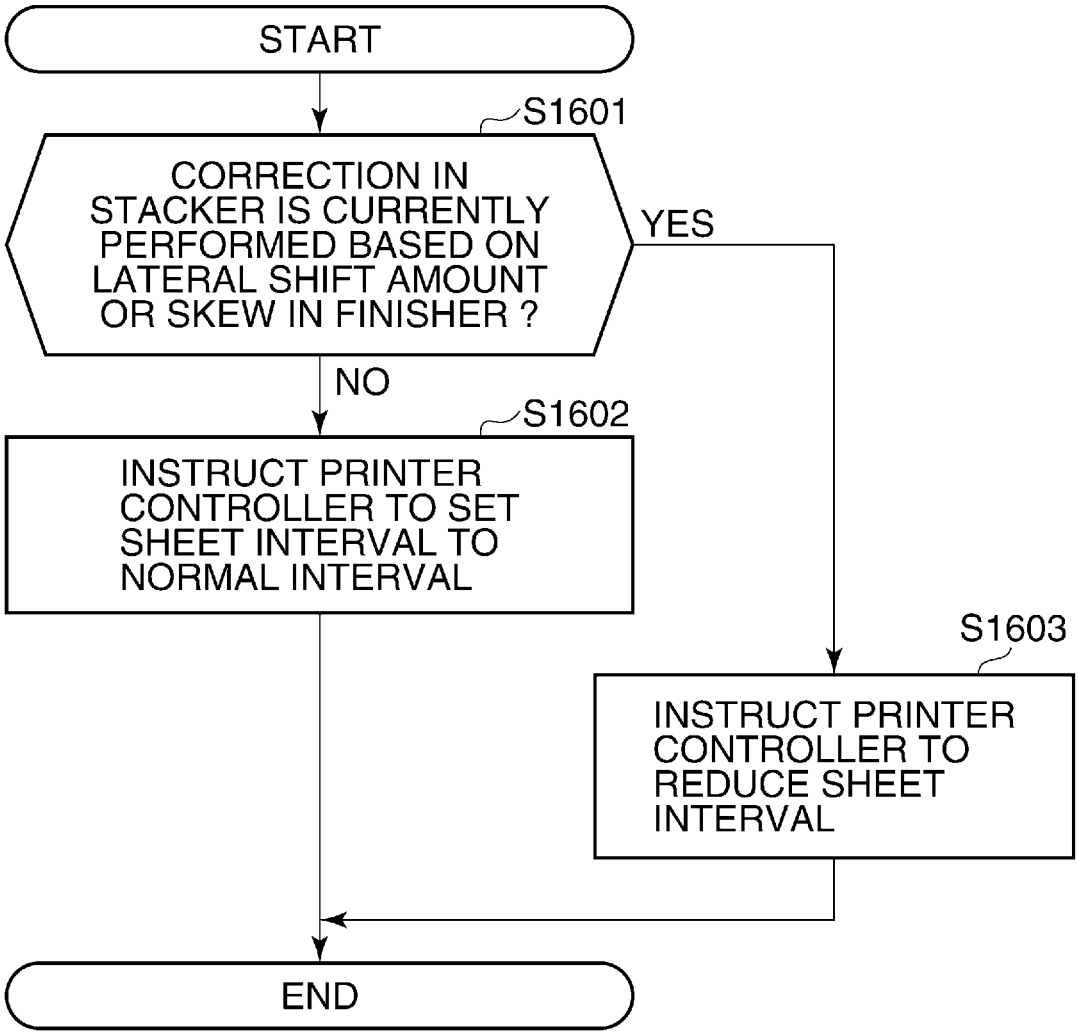
FIG. 19 is a flowchart of a sheet interval selection-instructing process.

FIG. 19 is a flowchart of a sheet interval selection-instructing process. This process is executed by the stacker controller 701 at predetermined time intervals. First, the stacker controller 701 determines whether or not the sheet position correction currently performed in the stacker 400 is the predictive correction based on the lateral shift correction amount D1 and the skew correction amount D2 (step S1601). More specifically, it is determined whether or not the lateral shift correction is currently performed based on both the lateral shift amount Xf and the lateral shift amount Xs, and the skew correction is currently performed based on both the skew amount L6*f* and the skew amount L6*s* (step S1601). If the sheet position correction currently performed is not the predictive correction, the stacker controller 701 sends a selection instruction for causing selection of the first sheet interval as a normal sheet interval to the printer controller 304 (step S1602). On the other hand, if the sheet position correction currently performed is the predictive correction, the stacker controller 701 sends a selection instruction for causing selection of the second sheet interval which is shorter than the first sheet interval to the printer controller 304 (step S1603). After execution of the step S1602 or S1603, the present process is terminated.

Figure 20:
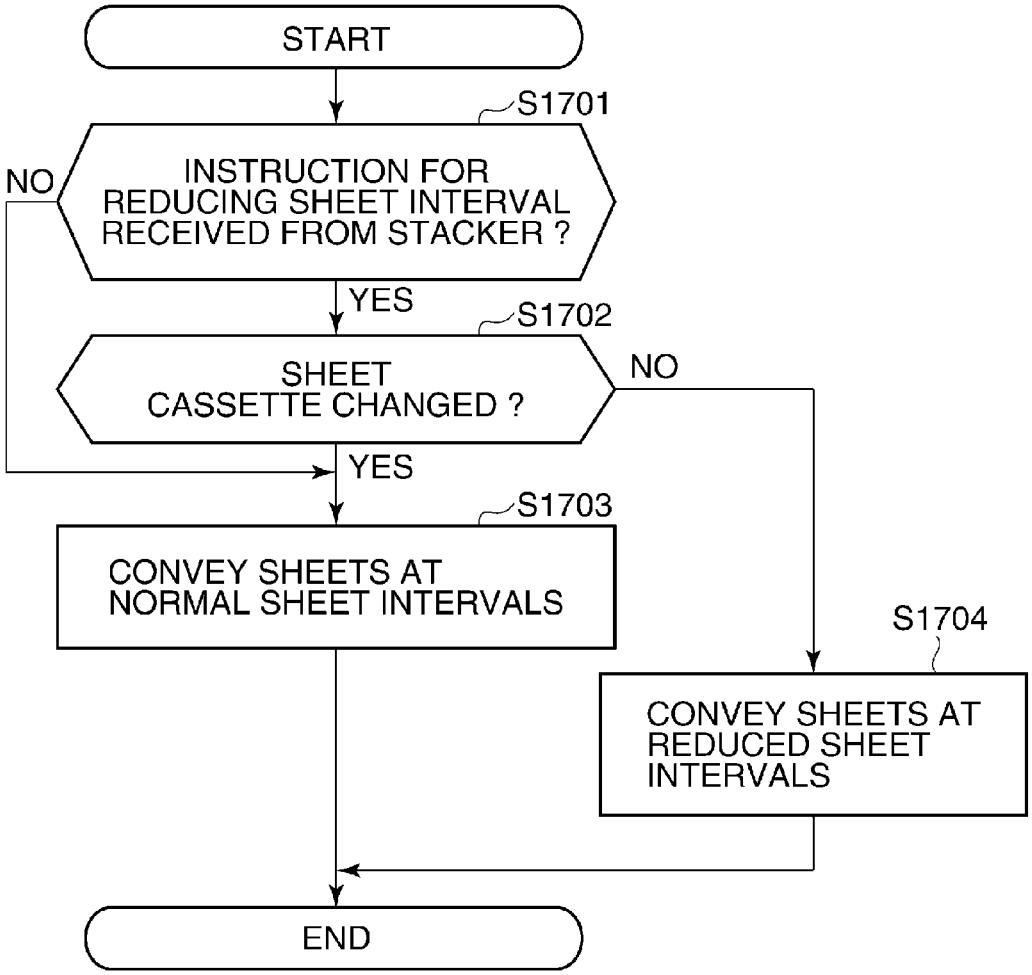
FIG. 20 is a flowchart of a sheet interval-changing process.

FIG. 20 is a flowchart of a sheet interval-changing process. This process is executed by the image forming apparatus controller 305 of the image forming apparatus 300 at predetermined time intervals.

First, the image forming apparatus controller 305 determines whether or not the printer controller 304 has received the selection instruction for causing selection of the second sheet interval from the stacker controller 701 (step S1701). If the selection instruction for causing selection of the second sheet interval has not been received, the image forming apparatus controller 305 selects the first sheet interval as the normal one in a step S1703, and controls the printer controller 304 to convey sheets at the selected first sheet intervals. On the other hand, if the selection instruction for causing selection of the second sheet interval has been received, the image forming apparatus controller 305 determines whether or not switching between sheet feed cassettes (cassettes 909*a* to 909*d*) has been performed (step S1702). If switching between sheet feed cassettes has been performed, the process proceeds to the step S1703, wherein the image forming apparatus controller 305 selects the first sheet interval and controls the printer controller 304 to convey sheets at the first sheet intervals. The reason for selecting the first sheet interval is that the switching between sheet feed cassettes can cause a change in the state of skew or lateral shift of a sheet. On the other hand, if the switching between sheet feed cassettes has not been performed, the image forming apparatus controller 305 selects the second sheet interval shorter than the first sheet interval and controls the printer controller 304 to convey sheets at the second sheet intervals (step S1704). It is assumed that the sheet interval is set to such an interval that makes it possible for the finisher 100 to secure sufficient time for performing sheet processing. If the sheet position correction has already been performed by the stacker (based on the finisher output), the finisher does not need extra time for correction and the interval between consecutive sheets can be reduced.

From the viewpoint of simplifying processing, the determination in the step S1601 may be performed only as to whether or not the lateral shift correction performed in the stacker 400 is the predictive correction based on the lateral shift correction amount D1. Alternatively, the determination may be performed only as to whether or not the skew correction performed in the stacker 400 is the predictive correction based on the skew correction amount D2.

According to the present embodiment, the lateral shift correction amount D1 is computed based on both the lateral shift amount Xs detected in the stacker 400 and the lateral shift amount Xf that the stacker 400 receives as a result of detection in the finisher 100, and the skew correction amount D2 is computed based on both the skew amount L6*s* detected in the stacker 400 and the skew amount L6*f* that the stacker 400 receives as a result of detection in the finisher 100. The lateral shift and skew of a sheet is corrected based on the computed lateral shift correction amount D1 and the computed skew correction amount D2, respectively. There may be a lateral shift correction based only on the sheet positional error going into the stacker or only into the finisher. Similarly, there may be a skew correction based only on the sheet positional error of the stacker or the finisher. In short, in the stacker 400, the lateral shift correction and skew correction of a sheet are performed based on the amounts of lateral shift and/or skew to be caused by conveying of the sheet into the finisher 100 on the downstream side (as well as the amounts of lateral shift and/or skew caused by conveying the sheet into the stacker itself, if appropriate). This makes it possible to reduce the amount of lateral shift or skew of the sheet which actually occurs before the sheet has been conveyed into the finisher 100. Therefore, sheet correcting time in the finisher 100 on the downstream side is reduced, which makes it possible to perform sheet processing without degrading productivity and processing accuracy. In other words, it is possible to maintain productivity and processing accuracy at the same time.

Further, when it is possible to reduce sheet correcting time in the finisher 100 on the downstream side, the instruction for causing selection of the second sheet interval is sent to the image forming apparatus 300 to reduce the sheet interval, which results in improvement of productivity.

Although in the present embodiment, the lateral shift correction and the skew correction are performed in parallel, this is not limitative, but only one of them may be performed. In this case, if a method in which only the lateral shift correction is performed is employed in FIG. 19, it is only required to cause the selection instruction for causing selection of the second sheet interval to be issued only when correction based on the lateral shift correction amount D1 has been performed. On the other hand, if a method in which only skew correction is performed is employed, it is only required to cause the selection instruction for causing selection of the second sheet interval to be issued only when correction based on the skew correction amount D2 has been performed.

It should be noted that the sheet processing system needs only a plurality of sheet processing apparatuses connected in series so as to perform sheet position correction in an upstream sheet processing apparatus based on the amounts of lateral shift and skew to be caused by conveying of a sheet into a downstream sheet processing apparatus, but the number of the sheet processing apparatuses is optional under condition that the upstream and downstream relationship is established between at least two sheet processing apparatuses. Further, at least two sheet processing apparatuses for use in the above-described sheet processing are not necessarily required to be arranged continuously, but another apparatus may be interposed between the apparatuses.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2009-245533, filed Oct. 26, 2009, which is hereby incorporated by reference herein in its entirety.

What is claimed is:

1. A sheet processing system including a first sheet processing apparatus and a second sheet processing apparatus connected to the first sheet processing apparatus downstream of the first sheet processing apparatus in a sheet conveying direction, wherein the first sheet processing apparatus comprises:

a first detection unit configured to detect a first positional error of a first sheet conveyed into the first sheet processing apparatus; and a correction unit configured to correct a position of the first sheet, and wherein the second sheet processing apparatus comprises:

a second detection unit configured to detect a second positional error of the first sheet that is conveyed into the second sheet processing apparatus after the first positional error has been corrected by said correction unit; and a transmission unit configured to send the second positional error detected by said second detection unit to the first sheet processing apparatus, and wherein the first sheet processing apparatus further comprises:

a reception unit configured to receive the second positional error sent from said transmission unit of the second sheet processing apparatus, and wherein said correction unit is further configured to correct a position of a second sheet following the first sheet based on both a first positional error of the second sheet detected by said first detection unit and the second positional error of the first sheet received by said reception unit.

2. The sheet processing system according to claim 1, wherein the first positional error includes a lateral shift amount of a sheet conveyed into the first sheet processing apparatus and the second positional error includes a lateral shift amount of a sheet conveyed into the second sheet processing apparatus.

3. The sheet processing system according to claim 2, wherein the first positional error includes a skew amount of a sheet conveyed into the first sheet processing apparatus and the second positional error includes a skew amount of a sheet conveyed into the second sheet processing apparatus.

4. The sheet processing system according to claim 2, wherein said correction unit is configured to determine a lateral shift correction amount for correcting the lateral position of the sheet by incorporating a correction amount for compensating for the lateral shift amount received by said reception unit into a correction amount for compensating for the lateral shift amount detected by said first detection unit.

5. The sheet processing system according to claim 1, wherein the first positional error includes a skew amount of a sheet conveyed into the first sheet processing apparatus and the second positional error includes a skew amount of a sheet conveyed into the second sheet processing apparatus.

6. The sheet processing system according to claim 5, wherein said correction unit is configured to determine a skew correction amount by incorporating a correction amount for compensating for the skew amount received by said reception unit into a correction amount for compensating for the skew amount detected by said first detection unit.

7. The sheet processing system according to claim 1, wherein the second sheet processing apparatus comprises a second correction unit configured to correct a position of a sheet based on the second positional error.

8. A sheet processing system including a first sheet processing apparatus and a second sheet processing apparatus disposed downstream of the first sheet processing apparatus in a sheet conveying direction, wherein the first sheet processing apparatus comprises:

a first detection unit configured to detect a first positional error of a sheet conveyed into the first sheet processing apparatus, the first positional error including a lateral shift amount of a sheet conveyed into the first sheet processing apparatus; and a correction unit configured to correct a position of the sheet, and wherein the second sheet processing apparatus comprises:

a second detection unit configured to detect a second positional error of the sheet conveyed into the second sheet processing apparatus, the second positional error including a lateral shift amount of a sheet conveyed into the second sheet processing apparatus; and a transmission unit configured to send the second positional error detected by said second detection unit to the first sheet processing apparatus, and wherein the first sheet processing apparatus further comprises:

a reception unit configured to receive the second positional error sent from said transmission unit of the second sheet processing apparatus, and wherein said correction unit is further configured to correct a position of subsequent sheets based on both the first positional error detected by said first detection unit and the second positional error received by said reception unit;

wherein said correction unit configured to determine a lateral shift correction amount for correcting the lateral position of the sheet by incorporating a correction amount for compensating for the lateral shift amount received by said reception unit into a correction amount for compensating for the lateral shift amount detected by said first detection unit.

9. A sheet processing system including a first sheet processing apparatus, a second sheet processing apparatus disposed downstream of the first sheet processing apparatus in a sheet conveying direction, and an image forming apparatus disposed upstream of the first sheet processing apparatus, wherein the first sheet processing apparatus comprises:

a first detection unit configured to detect a first positional error of a sheet conveyed into the first sheet processing apparatus; and a correction unit configured to correct a position of the sheet, and wherein the second sheet processing apparatus comprises:

a second detection unit configured to detect a second positional error of the sheet conveyed into the second sheet processing apparatus; and a transmission unit configured to send the second positional error detected by said second detection unit to the first sheet processing apparatus, and wherein the first sheet processing apparatus further comprises:

a instruction unit configured to output an instruction for reducing a sheet conveying interval to the image forming apparatus when the second positional error has been received by said reception unit; and a reception unit configured to receive the second positional error sent from said transmission unit of the second sheet processing apparatus, and wherein said correction unit is further configured to correct a position of subsequent sheets based on both the first positional error detected by said first detection unit and the second positional error received by said reception unit.

10. A sheet processing apparatus to which another sheet processing apparatus having a feature of detecting a positional error of a sheet is connected downstream of the sheet processing apparatus, the sheet processing apparatus comprising:

a detection unit configured to detect a first positional error of a first sheet conveyed into the sheet processing apparatus;

a correction unit configured to correct a position of the first sheet; and a reception unit configured to receive a second positional error of the first sheet that is conveyed into the another sheet processing apparatus after the first positional error has been corrected by said correction unit, wherein said correction unit is configured to correct a position of a second sheet following the first sheet based on both a first positional error of the second sheet detected by said detection unit and the second positional error of the first sheet received by said reception unit.

11. The sheet processing apparatus according to claim 10, wherein the first positional error includes a lateral shift amount of the sheet conveyed into a sheet processing apparatus; and the second positional error comprises a lateral shift amount of a sheet conveyed into the another sheet processing apparatus.

12. The sheet processing apparatus according to claim 10, wherein the first positional error includes a skew amount of the sheet conveyed into a sheet processing apparatus; and the second positional error comprises a skew amount of a sheet conveyed into the another sheet processing apparatus.

13. A sheet processing apparatus to which another sheet processing apparatus having a feature of detecting a positional error of a sheet and a feature of correcting the detected positional error of the sheet is connected upstream of the sheet processing apparatus, the sheet processing apparatus comprising:

a detection unit configured to detect a positional error of a first sheet that is conveyed into the sheet processing apparatus after a positional error has been corrected by the another sheet processing apparatus; and a transmission unit configured to send the positional error of the first sheet detected by the detection unit to the another sheet processing apparatus, in order to correct a positional error of a second sheet following the first sheet by the another sheet processing apparatus.

14. The sheet processing apparatus according to claim 13, wherein the positional error detected by the detection unit includes a lateral shift amount of a sheet conveyed into the sheet processing apparatus; and the positional error detected by the another sheet processing apparatus comprises a lateral shift amount of a sheet conveyed into the another sheet processing apparatus.

15. The sheet processing apparatus according to claim 13, wherein the positional error detected by the detection unit includes a skew amount of a sheet conveyed into the sheet processing apparatus; and the positional error detected by the another sheet processing apparatus comprises a skew amount of a sheet conveyed into the another sheet processing apparatus.

16. The sheet processing system according to claim 13, wherein the sheet processing apparatus comprises a correction unit configured to correct a position of a sheet based on the positional error detected by the detection unit.

17. A method of controlling a sheet processing system that comprises an upstream sheet processing apparatus and a downstream processing apparatus, each sheet processing apparatus comprising a detection unit for detecting a sheet positional error and a correction unit for correcting the sheet position, the method comprising:

in the upstream sheet processing apparatus, detecting a first positional error of a first sheet conveyed into the upstream sheet processing apparatus;

in the upstream sheet processing apparatus, correcting a position of the first sheet based on the first positional error;

in the downstream sheet processing apparatus, detecting a second positional error of the first sheet that is conveyed into the downstream sheet processing apparatus after the position of the first sheet has been corrected by the upstream sheet processing apparatus;

transmitting a signal containing the second positional error from the downstream sheet processing apparatus to the upstream sheet processing apparatus;

in the upstream sheet processing apparatus, detecting a first positional error of a second sheet following the first sheet; and in the upstream sheet processing apparatus, correcting a sheet position of the second sheet based on the second positional error of the first sheet sent from the downstream sheet processing apparatus and the detected first positional error.

* * * * *